US005617198A

United States Patent [19]

Ishikawa et al.

[11] Patent Number: 5,617,198

[45] Date of Patent: Apr. 1, 1997

[54] IMAGE FORMING APPARATUS HAVING ROTARY DEVELOPING DEVICE

[75] Inventors: Tomoji Ishikawa; Kazuyuki Sugihara, both of Yokohama; Katsuhiro Kosuge, Tokyo, all of Japan

[73] Assignee: Ricoh Company, Ltd., Tokyo, Japan

[21] Appl. No.: 425,985

[22] Filed: Apr. 20, 1995

[30] Foreign Application Priority Data

| | | | |
|---|---|---|---|
| Apr. 22, 1994 | [JP] | Japan | 6-107780 |
| Apr. 22, 1994 | [JP] | Japan | 6-107781 |
| Mar. 21, 1995 | [JP] | Japan | 7-088886 |

[51] Int. Cl.[6] ..... G03G 15/01

[52] U.S. Cl. ..... 399/27; 399/119; 399/262

[58] Field of Search ..... 355/204, 208, 355/245, 246, 260, 326 R, 327; 222/DIG. 1

[56] References Cited

U.S. PATENT DOCUMENTS

| | | | |
|---|---|---|---|
| 3,987,756 | 10/1976 | Katayama et al. . | |
| 4,615,612 | 10/1986 | Ohno et al. . | |
| 4,620,783 | 11/1986 | Tanaka et al. | 355/245 X |
| 4,782,360 | 11/1988 | Iwamoto et al. | 355/326 R |
| 4,821,075 | 4/1989 | Saito et al. | 355/260 X |
| 4,922,301 | 5/1990 | Katoh et al. | 355/326 X |
| 5,198,866 | 3/1993 | Kimura et al. | 355/326 R |

FOREIGN PATENT DOCUMENTS

| | | |
|---|---|---|
| 60-260968 | 12/1985 | Japan . |
| 61-117575 | 6/1986 | Japan . |
| 62-50842 | 3/1987 | Japan . |
| 4-119369 | 4/1992 | Japan . |
| 5-232815 | 9/1993 | Japan . |
| 6-258905 | 9/1994 | Japan . |
| 2165776 | 4/1986 | United Kingdom . |

*Primary Examiner*—Sandra L. Brase

*Attorney, Agent, or Firm*—Oblon, Spivak, McClelland, Maier & Neustadt, P.C.

[57] ABSTRACT

In an image forming apparatus, a rotary developing unit or revolver is loaded with a removable black developer container at the center thereof. The container is formed with a toner outlet. A receptacle assigned to black toner is provided at the end of the axis of the revolver and formed with a toner inlet. The receptacle constitutes a hopper portion. A supply roller is disposed in the receptacle. A screw conveyor extends out from a black developing chamber defined in the revolver into a communication chamber which communicates the receptacle to the developing chamber. A shutter is located at the loner inlet of the receptacle and rotatable due to its own weight while the revolver is in rotation. When more than a predetermined number of printings are produced by use of the black developing chamber, printing is interrupted. Then, the revolver is rotated to transfer the toner from the container to the hopper portion. The revolver may be rotated every time a single printing is produced.

15 Claims, 27 Drawing Sheets

IMAGE FORMING APPARATUS HAVING ROTARY DEVELOPING DEVICE

BACKGROUND OF THE INVENTION

The present invention relates to a copier, facsimile apparatus, printer or similar image forming apparatus and, more particularly, to an image forming apparatus of the type having a rotary developing device.

An image forming apparatus having a rotary developing device, or revolver as generally referred to, is disclosed in Japanese Patent laid-Open Publication Nos. 62-25 1772 and 63-78170 and Japanese Utility Model laid-Open Publication No. 63-41164 by way of example. The revolver is made up of a rotary developing unit, a rotary toner storing unit, and toner toner conveying means. The developing unit is rotatable in the vicinity of an image carrier in the form of a photoconductive drum and has a plurality of developing sections or chambers thereinside. The storing unit is coaxially provided on one end of the developing unit. A plurality of storing chambers are defined in the storing unit in one-to-one correspondence with the developing chambers, and each stores toner of particular color. Each storing chamber is communicated to one of the developing chambers by the conveying means.

The developing chambers and storing chambers are related such that the conveying means exists, when the associated developing chamber is located at a developing position where it faces the image carrier, at a position in the respective storing chamber where the toner gathers due to its own weight, e.g., at a lower portion of the storing chamber. The conveying means suitably replenishes fresh toner from the storing chamber into the developing chamber in which either a one-component type developer, or toner, or a two-component type developer, or toner and carrier mixture, is present. When the storing chamber runs out of the toner, toner must be replenished into the chamber from the outside. To save time and labor for the replenishment, the storing chamber should preferably be implemented as a toner container or cartridge removably mounted to the developing unit. Then, a container run out of toner will be readily replaced with a new toner container full of fresh toner. Laid-Open Publication No. 63-41164 mentioned earlier teaches a plurality of toner containers removably mounted to the developing unit.

When the containers are removably mounted to the developing unit, it is not desirable that the conveying means, protruding from the developing chambers toward the containers be left bare. Preferably, there are provided toner inlet portions surrounding the conveying means. The inlet portions are each provided with an inlet corresponding to the outlet of the associated container. The inlet portions are communicated to the respective developing chambers. This kind of configuration prevents the operator from touching the conveying means which would smear the operator's hands and cloths. The containers, inlet portions and developing chambers should preferably be related such that when one developing chamber is located at the developing position, the toner stored in the associated container flows into the inlet due to its own weight, and such that the conveying means exists in the inlet portion at a position where the incoming toner is present.

However, it is sometimes impossible to guarantee a space great enough to accommodate a plurality of containers for layout reasons and, therefore, to combine the containers and developing chambers in the relation stated above. Then, priority must be given to the relation between the developing chambers and the inlet portions which directly contribute to the replenishment of toner; that is, the preferable relation between the containers and the inlet portions must be sacrificed. More specifically, to allow the toner conveying means to exist, when the developing chamber is held at the developing position, at the position in the inlet portion where the toner is present, the toner in the container cannot flow into the inlet portion despite its own weight. Hence, when one developing chamber is held at the developing position to effect image formation continuously, the replenishment of toner into the chamber fails as soon as the toner in the inlet portion is fully consumed.

The above problem also occurs with a developing device having a single developing chamber and a single toner container, so long as it is a rotary developing device. Further, assume that the container is not located on an axis extending out from one side of the developing chamber, but it is located radially inwardly or outwardly of the chamber, and that the toner is directly supplied from the container to the chamber without the intermediary of the conveying means. Even this kind of scheme will have the same problem if an arrangement is so made as to allow the toner to be fed from the container to the chamber only when the outlet of the container and the inlet of the chamber lie in a predetermined angular range.

The container may be longer at one end than the other end where the outlet is present, and may be so configured as to move the toner existing at the one end toward the outlet due to the rotation of the developing unit. However, after the toner around the outlet has been replenished into the developing chamber, the remaining toner cannot be fed into the chamber unless the developing unit rotates.

Even when direct or indirect sensing means determines that the container has run out of the toner, the toner often remains cohered around the outlet of the container. If the container with the cohered toner is pulled out of the developing unit, the toner drops from the outlet and contaminates the surrounding. In addition, this is not desirable in the aspect of the effective use of toner.

Because the containers differ from each other as to the time when they run out of toner, they should preferably be replaceable independently of each other. In such a case, although the empty state of a container (referred to as a near end condition hereinafter) may be displayed on the operation panel of the apparatus, it is difficult for the operator to identify the empty toner. For example, the operator must pull out the containers one by one and feel their weights.

A mount portion for mounting the container is included in the revolver body, i.e., in the developing chamber itself or in a portion communicated to the chamber. The relation between the inlet formed in the mount portion and the outlet of the container in the up-and-down direction changes with a change in the angular position of the revolver, i.e., the position of the container. Therefore, when the containers are replaceable independently of each other and if one of the containers is pulled out, while the toner is present in the inlet of the chamber, at an angular position where the inlet is disposed above he outlet of the container, the toner in and around the inlet drops and contaminates the surrounding.

Moreover, assume that the configuration of the outlet of the container is apt to gather the toner therearound. Then, if the container is pulled out at an angular position where the outlet of the container is disposed above the inlet of the chamber, the toner also drops from the outlet of the container.

SUMMARY OF THE INVENTION

It is, therefore, an object of the present invention to provide an image forming apparatus having a revolver which obviates, when toner is still present in a toner container, the failure of toner replenishment into a developing chamber by allowing the toner to be fed from the outlet of the container into the inlet of the chamber only when a developing unit lies in a predetermined angular range, and by conveying the toner from one end of the container to the other end where the outlet is present.

It is another object of the present invention to provide an image forming apparatus having a revolver which enhances easy and efficient replacement of a toner container.

An image forming apparatus of the present invention has a rotary developing unit adjoining an image carrier and having at least one developing section having a toner inlet, and a removable toner container storing toner to be replenished into the developing section and formed with a toner outlet. A drive source causes the developing unit to rotate. A controller interrupts, when image formation is repeated more than a predetermined number of times, the image formation and causes the drive source to locate the developing unit in a predetermined angular range of rotation. Only when the developing unit is positioned in the predetermined angular range, the toner is replenished from the toner container into the developing section or into a portion communicated to the developing section via the toner outlet and toner inlet.

Also, an image forming apparatus of the present invention has a rotary developing unit adjoining an image carrier and having at least one developing section having a toner inlet, and a removable toner container storing toner to be replenished into the developing section and formed with a toner outlet. A drive source causes the developing unit to rotate. A controller interrupts, when image formation is repeated more than a predetermined number of times, the image formation and causes the drive source to locate the developing unit in a predetermined angular range of rotation. The toner container is configured such that the toner, adjoining one end of the toner container opposite to the other end where the toner outlet is present, is conveyed toward the toner outlet due to the rotation of the developing unit.

Further, an image forming apparatus of the present invention has a plurality of developing sections. A plurality of toner containers each stores toner to be replenished into one of the developing sections. A plurality of mount portions are each communicated to one of the developing sections or the respective portion communicated to one of the developing sections, and has a toner inlet for receiving the toner from one of the toner containers removably mounted thereto. A holder holds the toner containers such that they are movable integrally with the mount portions within the apparatus. A drive source drives the holder such that the toner containers move within the apparatus. A plurality of sensors each directly or indirectly determines whether or not the toner is present in the respective toner container. A controller causes the drive source to operate for a predetermined period of time in response to the output of any of the sensors.

Moreover, an image forming apparatus of the present invention has a plurality of developing sections. A plurality of toner containers each stores toner to be replenished into one of the developing sections and has a respective toner outlet. A plurality of mount portions are each communicated to one of the developing sections or the respective portion communicated to one of the developing sections, and has a toner inlet for receiving the toner from one of the toner containers removably mounted thereto. A holder holds the toner containers such that they are movable integrally with the mount portions within the apparatus. A drive source drives the holder such that the toner containers move within the apparatus. A a plurality of sensors each directly or indirectly determines whether or not the toner is present in the respective toner container. A controller causes the drive source to move, in response to the output of any of sensors and only when the apparatus satisfies a predetermined condition, any of the toner containers run out of the toner to a predetermined position for replacement. The controller moves, when the apparatus satisfies the predetermined condition and if a plurality of toner containers have run out of the toner as determined by the respective sensors, one of the toner containers run out of the toner and closest to the predetermined position for replacement on a path of movement of the toner containers in a predetermined direction first.

BRIEF DESCRIPTION OF THE DRAWINGS

The above and other objects, features and advantages of the present invention will become apparent frown the following detailed description taken with the accompanying drawings in which:

FIG. 15 indicates the relationship between FIGS. 15A and 15B;

DESCRIPTION OF THE PREFERRED EMBODIMENT

Figure 1:
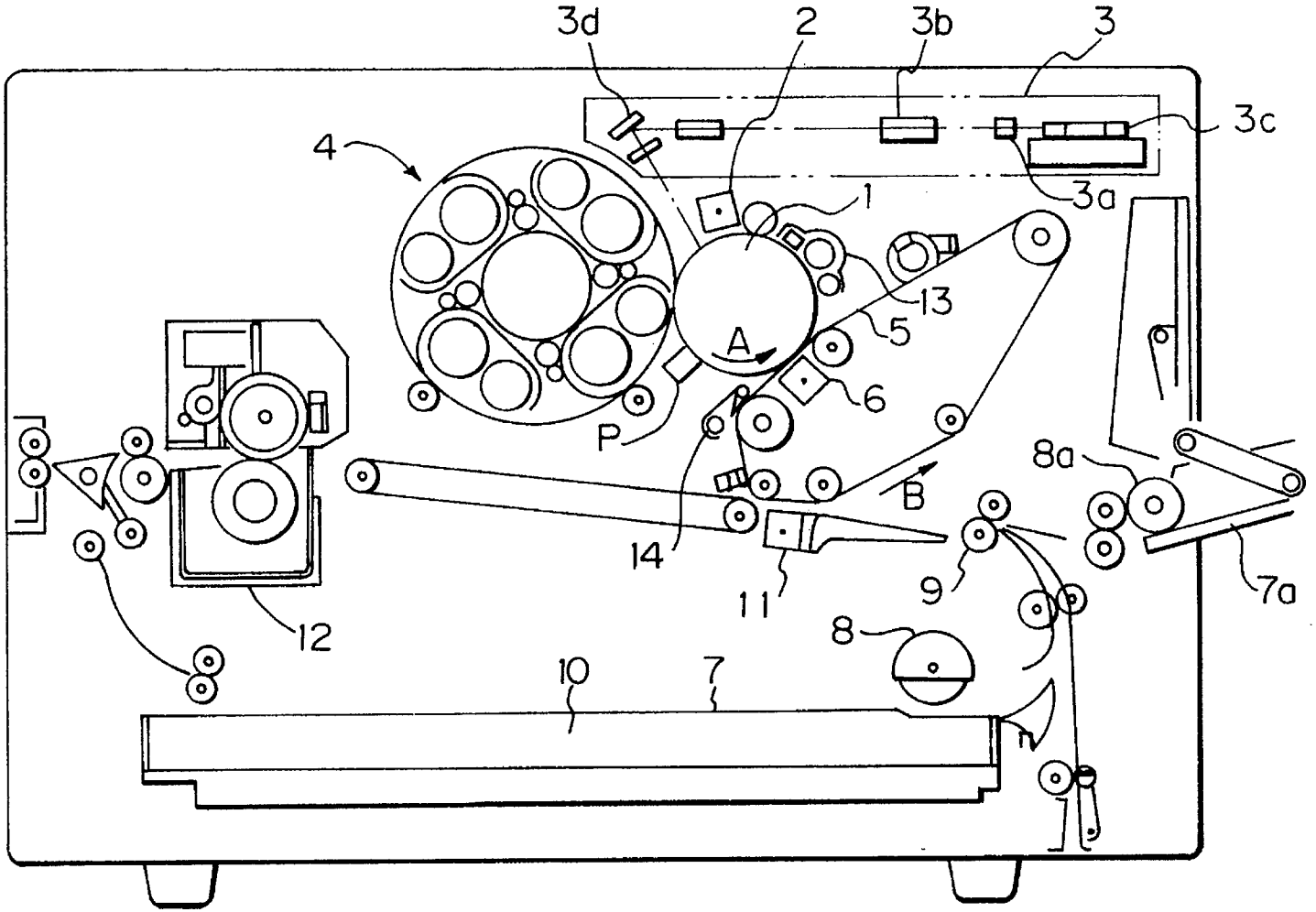
FIG. 1 is a sectional front view of an image forming apparatus embodying the present invention and implemented as an electrophotographic printer by way of example.

Referring to FIG. 1 of the drawings, an image forming apparatus embodying the present invention is shown and implemented as a electrophotographic color printer. As shown, the printer has a photoconductive drum, or image carrier, 1 which is rotated in a direction indicated by an arrow in the figure. A main charger 2 uniformly charges the surface of the drum 1. Laser optics 3 scans the charged surfaces of the drum 1 in accordance with image data and thereby electrostatically forms a latent image thereon. The image data consist of yellow data, magenta data, cyan data and black data generated by separating a desired full-color image. Latent images sequentially formed on the drum 1 are each developed by one of yellow toner, magenta toner, cyan toner and black toner stored in a rotary developing device or revolver 4 which will be described. As a result, the latent images are transformed to toner images of respective colors.

An intermediate transfer belt 5 is rotated in synchronism with the drum 1 in a direction B. The toner images formed on the drum 1 are sequentially transferred to the belt 5 by a primary transfer charger 6 one above the other, thereby forming a composite color image. A paper 10 is led from a duplex copy/automatic paper feed casette 7 or a manual paper teed tray 7*a* to an image transfer position by a pick-up roller 8 or 8*a* and a registration roller pair 9. A secondary transfer charger 11, located at the image transfer position, transfers the composite color image from the belt 5 to the paper 10. A fixing unit 12 fixes the color image on the paper 10. The paper 10 with the color image is driven out of the printer as a full-color printing. A drum cleaner 3 removes the toner remaining on the drum 1 after the image transfer. Likewise, a belt cleaner 14 removes the toner remaining on the belt 5 after the image transfer.

Figure 2:
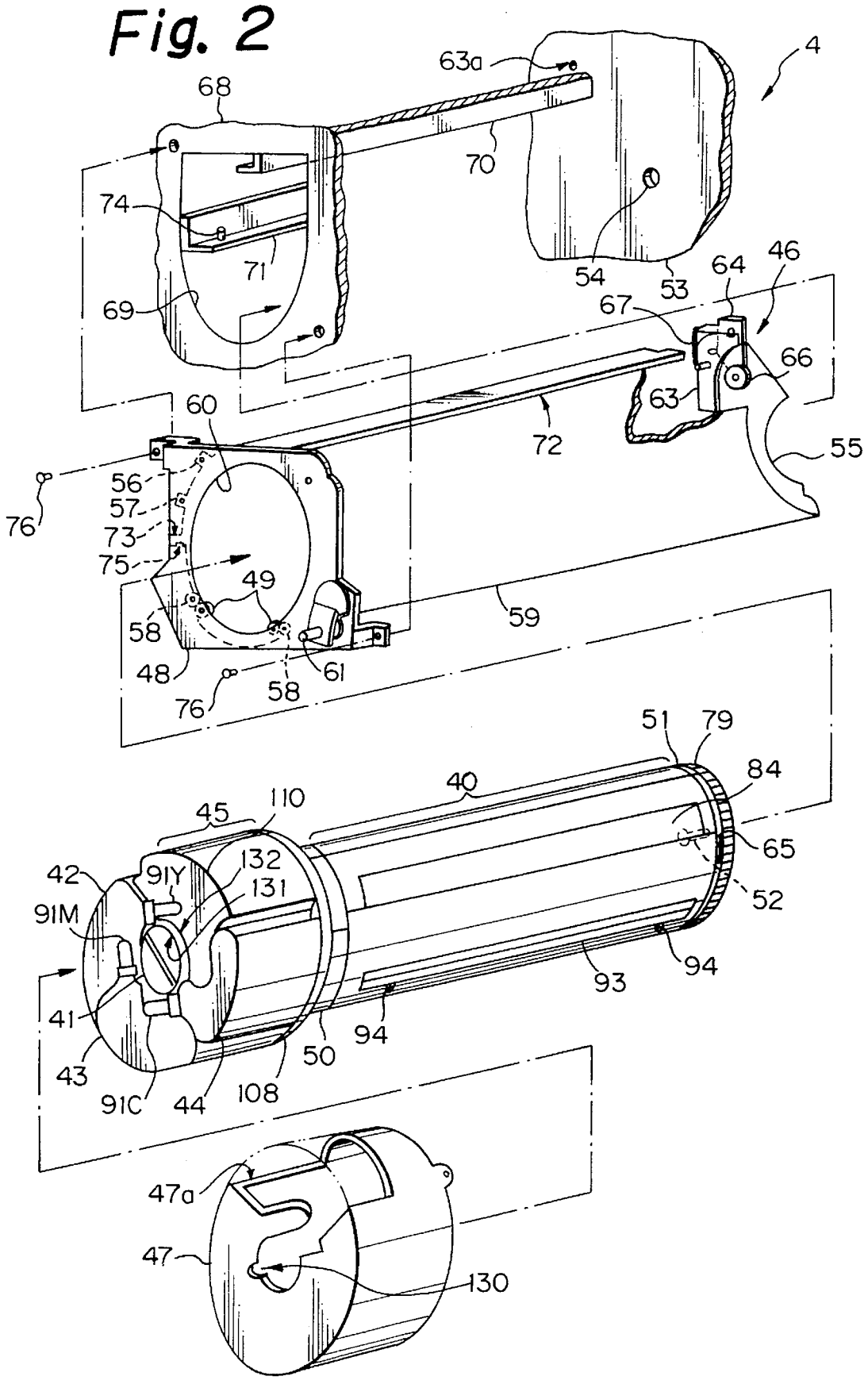
FIG. 2 is an exploded external perspective view of a revolver included in the embodiment.

As shown in FIG. 2, the revolver 4 has a substantially cylindrical developing unit 40 and a toner storing unit 45. The developing unit 40 is rotatable about its own axis and has four developing sections therein which are assigned to, for example, black, cyan, yellow, and magenta, respectively. The toner storing unit 45 is coaxial with and located at the front of the developing unit 40. Four toner containers 41, 42, 43 and 44 are removably mounted to the storing unit 45 and held in one-to-one correspondence with the four developing sections of the developing unit 40. The toner containers 41–44 store black toner, yellow toner, magenta toner, and cyan toner, respectively. The storing unit 45 is rotatable integrally with the developing unit 40. A casing 46 supports the developing unit and storing unit 45, i.e., the revolver and is slidable relative to the printer body substantially in parallel to the axis of the revolver. A cover 47, which is not rotatable, covers the storing unit 45.

Two support rollers 49, for example, are mounted on the front support wall 48 of the casing 46. The developing unit 40 has a front wall 50 and a rear wall 51 each having a disk-like configuration. The front wall 50 is supported by the support rollers 49. A tapered center shaft 52 extends out from the center of the rear wall 51 and rotatably received in a hole 54 formed in a rear panel 53 forming part of the printer body. In this condition, the revolver is rotatable in the printer body and positioned such that the axis thereof is parallel to the axis of the drum I substantially in the same plane, as shown in FIG. 1.

Figure 7A:
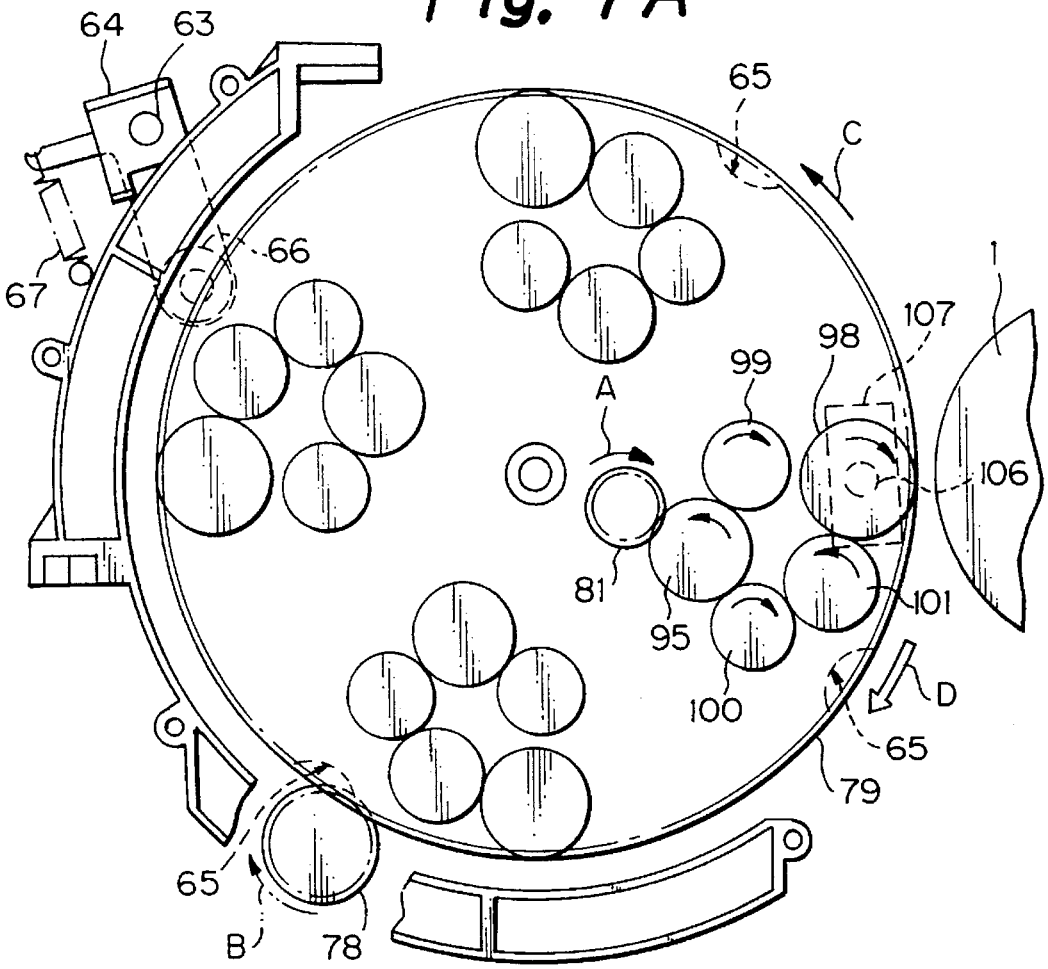
FIG. 7A is a perspective front view showing a driveline included in the revolver.
Figure 7B:
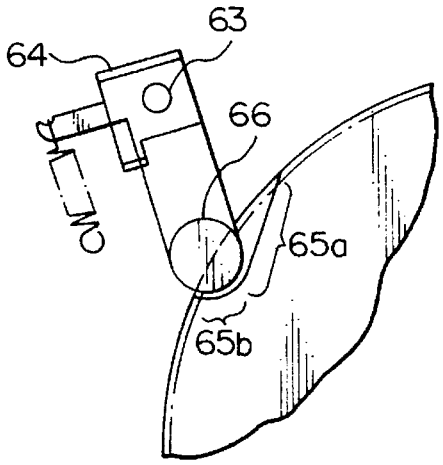
FIG. 7B shows an arrangement for applying a bias to the revolver.

The casing 46 has, in addition to the front support wall 48, a rear support wall 55 and a side cover 59. The side cover 59 is affixed to the support walls 48 and 55 at opposite ends thereof and reinforced by tie bars 56, 57 and 58. An opening 60 is formed through the front support wall 48 for receiving the revolver. A motor 61 and a gear train 62 (see FIG. 3) are also mounted on the support wall 48. The motor 61 drives via the gear train 62 toner supply rollers which are disposed in the toner storing unit 45. As shown in FIG. 4, an intermediate plate 63 is disposed in the casing 46 and supported by the tie bars 56 and 57 in the vicinity of the rear support wall 55. A positioning pin 63*b* is studded on the plate 63 and received in a positioning hole 63*a* formed in the rear panel 53. A bracket 64 is rotatably mounted at one end thereof on the part of the pin 63*b* intervening between the plate 63 and the rear support wall 55. A positioning roller 66 is mounted on the other end of the bracket 64. The roller 66 falls in any one of a plurality of (four in the embodiment) recesses 65 formed on the outer periphery of the rear end wall of the developing unit 40. A spring 67 constantly biases the bracket 64 in a direction indicated by an arrow. As a result, when one of the recesses 65 faces the roller 66, the roller 66 is surely caused to fall in the recess 65, as shown in FIGS. 7A and 7B specifically. How the revolver is positioned by use of the recesses 65, roller 66 and other constituents will be described in detail later.

A front panel 68 included in the printer body is formed with an opening 69 for receiving the casing 46 carrying the revolver therewith. An upper guide 70 and a lower guide 71 extend between the front panel 53 and the rear panel 68 of the printer body. The casing 46 is slidably supported by the guides 70 and 71. Specifically, the side cover 59 of the casing 46 has portions 72 and 73 to be guided by the guides 70 and 71 at the top and the side, respectively. A channel 73 is formed in the bottom of the portion 73 and receives an upright guide pin 74 studded on the guide 71. When the casing 46 is moved into and out of the printer body, the channel 75 causes it to move away from the drum 1. Also, when the casing 46 is fully set on the printer body, the channel 75 guides the revolver to a predetermined position relatively close to the drum 1. For this purpose, the channel 75 is bent such that a predetermined front portion thereof is closer to the drum 1 than a rear portion.

The positioning pin 63*b*, studded on the intermediate plate 63, has a tapered tip. The tapered tip begins to enter the hole 63*a* of the rear panel 53 immediately before the casing 46 is fully received in the printer body, and accurately positions the rear support wall 55 of the casing 46 when the casing 46 is fully received. The front support wall 48 of the casing 46 is affixed to the printer front panel 68 by, for example, screws 76 after the casing 46 has been inserted in the printer body. The screws 76 may be replaced with a tapered positioning pin, if desired. When the casing 46 is not inserted in the printer body, the rear end of the revolver is supported by the rear support wall 55 of the casing 46. However, immediately before the casing 46 is fully received in the printer body, the tapered center shaft 52 begins to enter the hole 54 of the printer rear panel 53, sequentially lifting the revolver. When the casing 46 is fully inserted into the printer body, the revolver is fully raised away from the support wall 55. In this condition, the front end of the revolver is supported by the rollers 49 of the front support wall 48 which has been accurately positioned on the printer body. At the same time, the rear end of the revolver is rotatably positioned relative to the printer rear panel 53.

Figure 3:
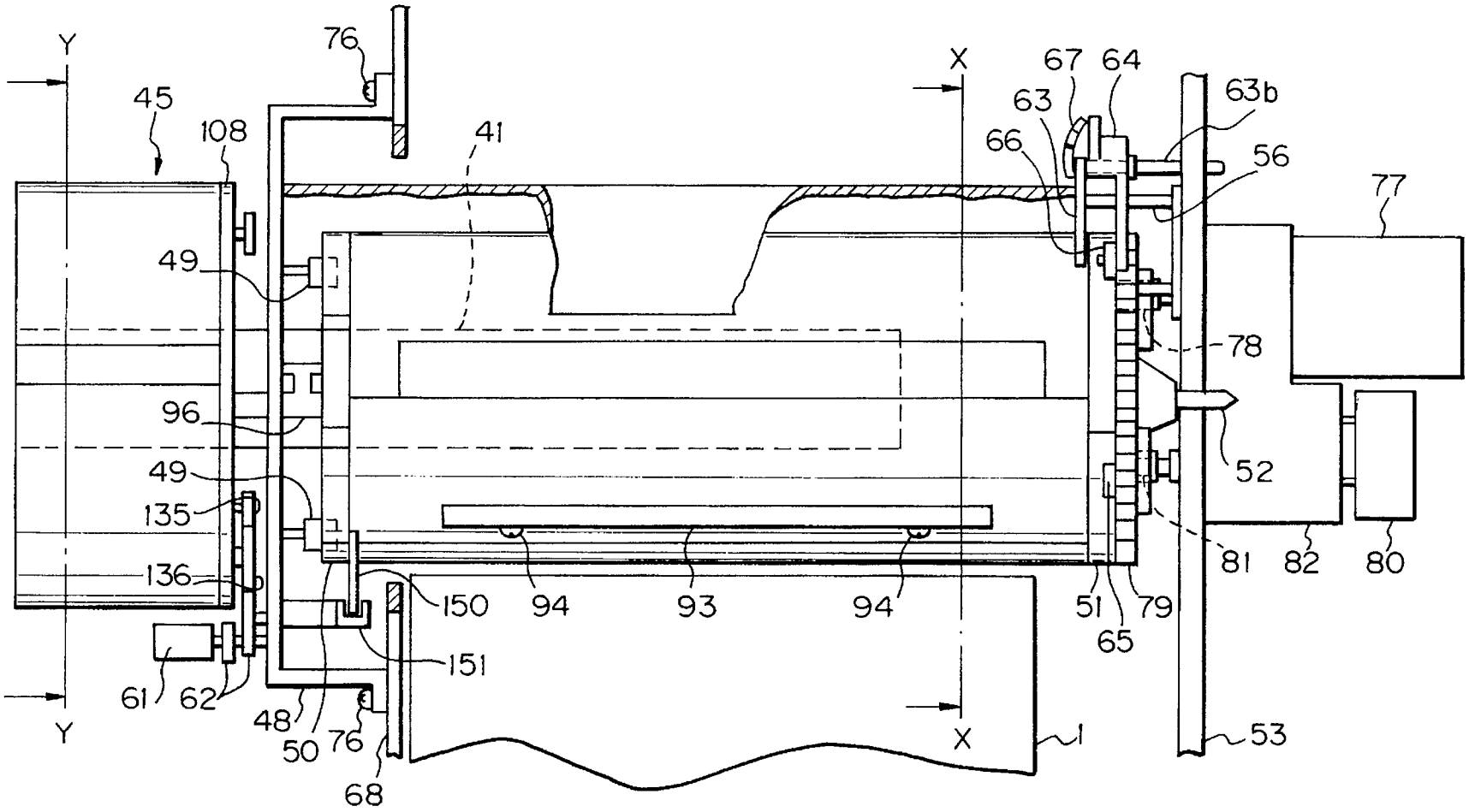
FIG. 3 is a plan view of the revolver.
Figure 4:
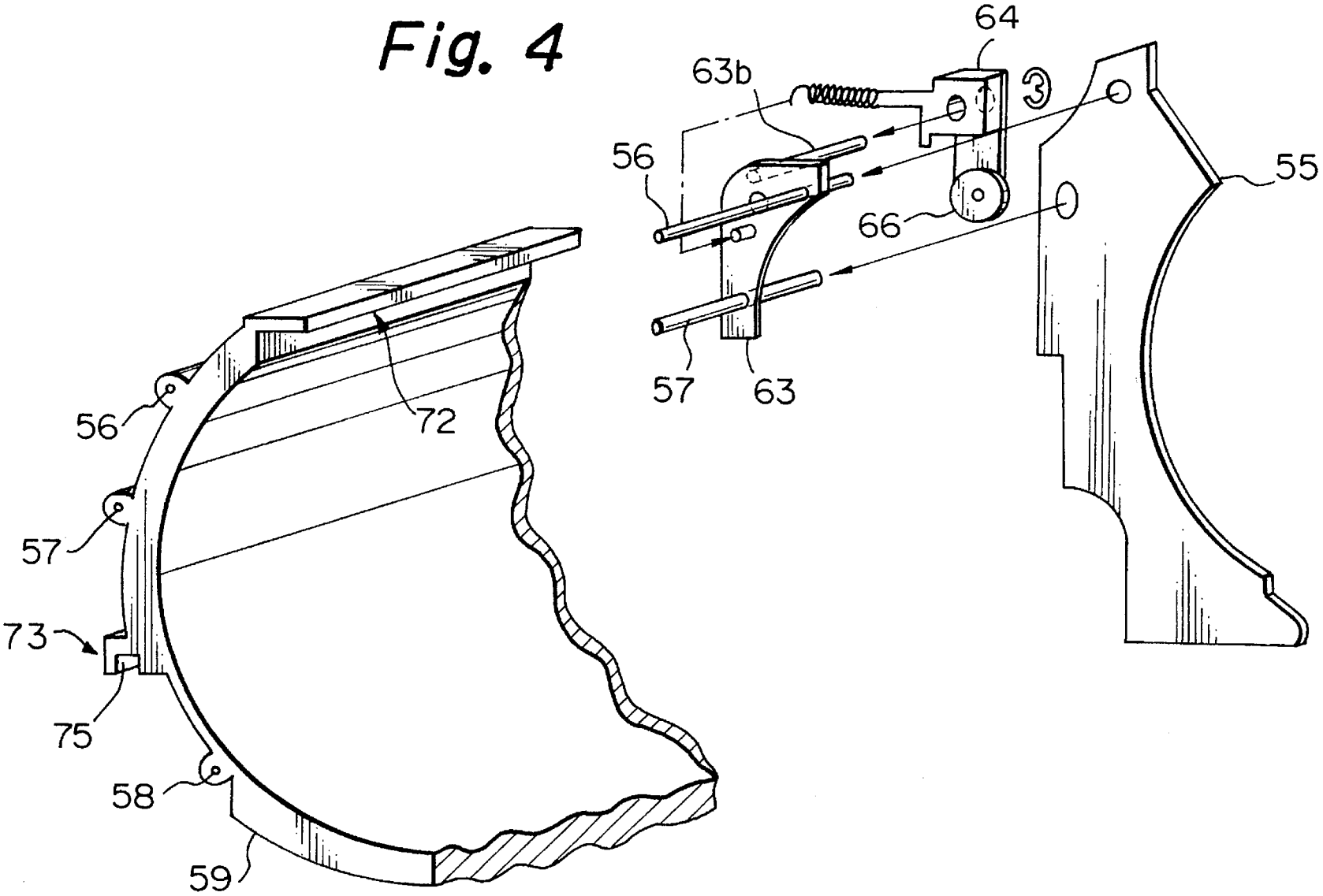
FIG. 4 is a fragmentary enlarged perspective view of the revolver.

As shown in FIG. 3, a motor 77 for driving the revolver is mounted on the printer rear panel 53 and implemented as a stepping motor by way of example. An output gear 78 is also mounted on the printer rear panel 53 and driven by the motor 77. The output gear 78 is held in mesh with an input gear 79 having substantially the same diameter as the output gear 78. The input gear 79 is fastened to the rear of the rear end wall of the developing unit 40. Also mounted on the printer rear panel 53 are a motor 80 for driving developing rollers and other rotary bodies built in the developing unit 40, an output gear 81 to be driven by the motor 80, a gear box 82 accommodating a gear train 62 connecting the motors to the respective output gears.

Figure 5:
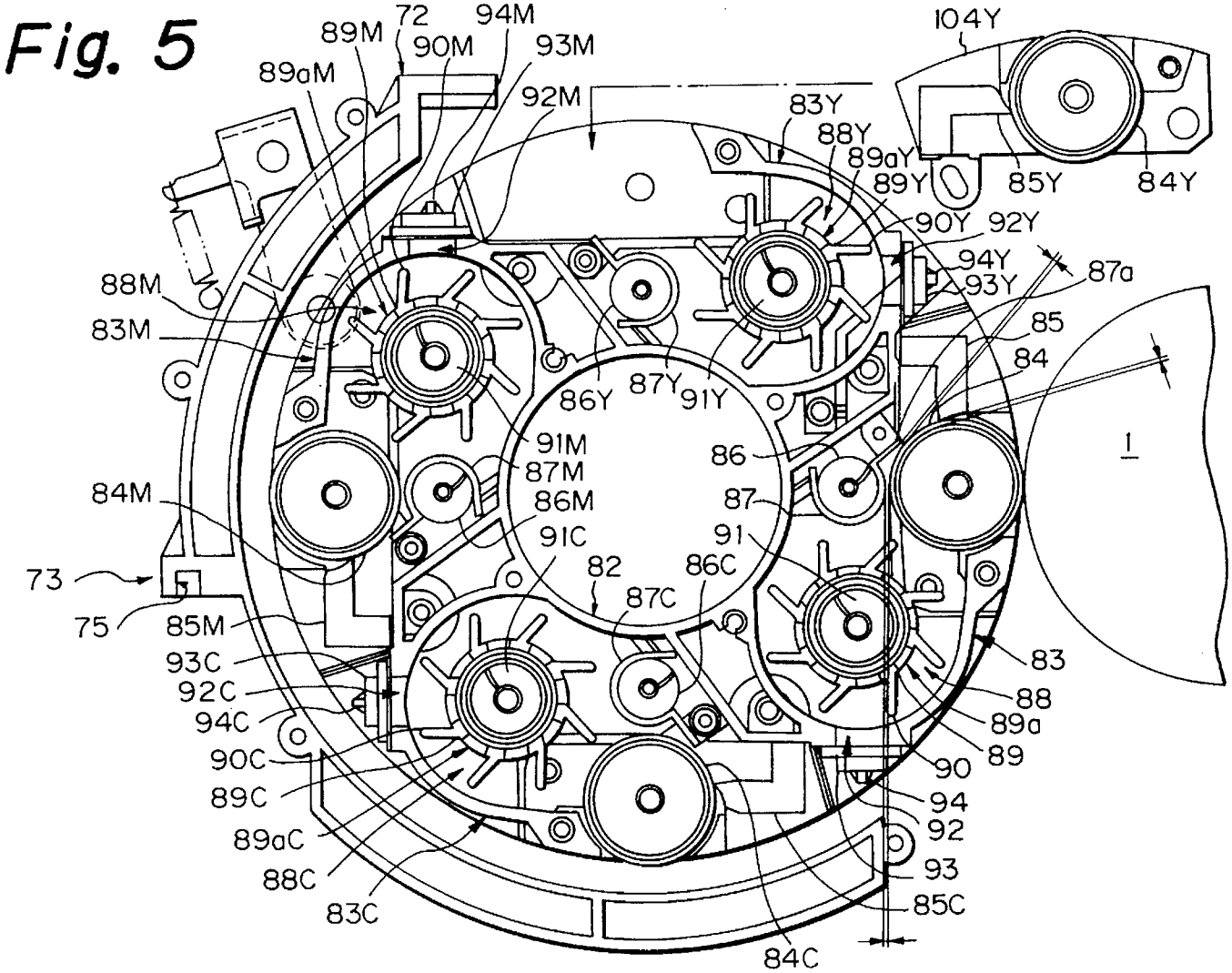
FIG. 5 is a section along line X—X of FIG. 3.

FIG. 5 is a section along line X—X of FIG. 3 and showing the internal arrangement of the developing unit 40. As shown, the developing unit 40 has, in addition to disk-like front and end walls (see FIG. 3), partition walls intervening between the front and rear walls. The partition walls consist of a hollow cylindrical portion 82 for receiving a cylindrical black toner bottle, and four casing portions 83, 83C, 83M and 83Y. The casing portions 83–83Y extend radially from the cylindrical portion 82 and partition the space around it into our developing chambers having substantially an identical shape. The chambers each stores a mixture of carrier and toner of particular color, i.e., a two-component type developer. In the condition shown in FIG. 5, the chamber storing the black toner and carrier is shown as facing the drum 1 at the developing position. The chambers storing the yellow toner and carrier, magenta toner and carrier, and cyan toner and carrier, respectively, are sequentially arranged in this order in the clockwise direction, as viewed in the figure.

The following description will concentrate on the black developing chamber located at the developing position. The other developing chambers are distinguished from the black developing chamber and from each other by suffixes Y, M and C.

In the black developing chamber, the casing part 83 is formed with an opening facing the drum 1. A developing roller 84 is positioned in the chamber and partly exposed to the outside through the opening. Also disposed in the chamber are a doctor blade 85, an upper screw 86, a guide 87 for the screw 86, and a paddle 88. The doctor blade 85 regulates the amount of toner to be conveyed by the roller 84 to the developing position. The upper screw 86 conveys part of the developer removed by the doctor blade 85 frown the rear to the front along the axis thereof. Specifically, the paddle 88 has a hollow cylindrical portion 89 formed with a plurality of developer outlets 89*a* extending in the axial direction of the roller 84, and a plurality of blades 90 extending radially from the portion 89. A lower screw 91 is disposed in the portion 89 and conveys the developer along the axis thereof in the opposite direction to the screw 86. The casing portion is formed with an outlet 92 below the lower screw 91. The outlet 92 extends in the axial direction of the revolver and is selectively used to discharge a deteriorated developer or to replenish a fresh developer (with toner). A cap 93 is fitted on the casing portion by, for example, a screw 94 in order to close the outlet 92.

To promote efficient discharge of the deteriorated developer from the outlet 92, it is preferable to pull out the revolver from the printer body together with the casing 46, rotate an input gear 95 (see FIG. 7A), as well as others, by use of a jig, and then discharge the developer while rotating the developing roller 84, screws 86 and 91, and paddle 88. Also, to introduce a fresh developer via the outlet 92, the roller 84, screws 86 and 91 and paddle should preferably be rotated in order to evenly scatter the developer.

Figure 6:
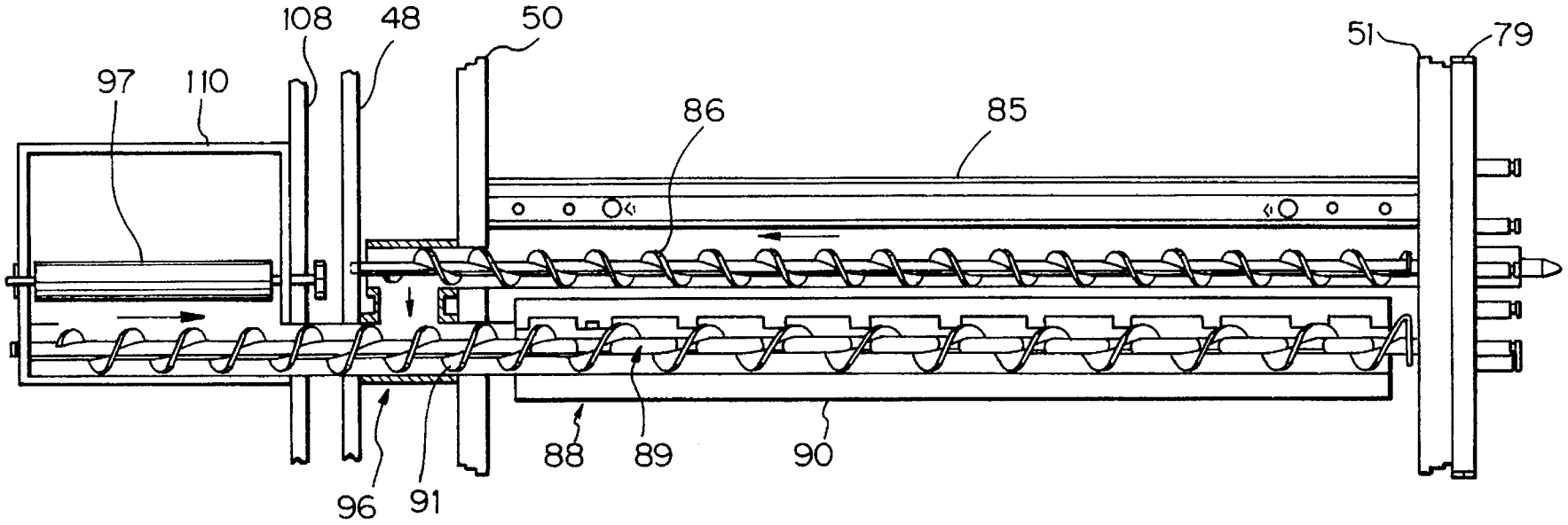
FIG. 6 is a section showing a communication structure between a developing section and a toner storing section included in the revolver.

FIG. 6 is a vertical section in a plane containing the axes of the upper and lower screws 86 and 91. As shown, the front ends of the screws 86 and 91 are extended to the outside of the effective width of the developing roller 84 (to the outside of the end wall 50 of the developing unit 40 in the illustrative embodiment). A drop section 96 is formed around the extensions of the screws 86 and 91. In the drop section 96, the developer conveyed by the screw 86 is dropped onto the screw 91 by gravity. The front end of the screw 91 is further extended beyond the drop section 96 to a communication chamber below a toner supply roller 97 which is included in the toner storing unit 45, as will be described specifically later. In this configuration, the developer deposited on the roller 84 is partly removed by the doctor blade 85 and then conveyed to the front by the guide 87 and screw 86. At the drop section 96, this part of the developer is dropped onto the screw 91. The screw 91 conveys the developer into the effective width of the roller 84. As a result, the developer is discharged from the paddle 88 into the chamber via the outlet 89*a* and again deposited on the roller 84. In this manner, the developer is agitated in the chamber in the horizontal direction. The developer discharged to the lower portion of the chamber via the outlets 89*a* is agitated by the blades 90 of the paddle 88 in the vertical direction. At the same time, the toner supply roller 97 is rotated to drop a fresh toner onto the screw 91 in the communication chamber. The screw 91 conveys the fresh toner to the drop section 96. On reaching the drop section 96, the toner is mixed with the developer dropped from the screw 86. The resulting mixture enters the chamber via the outlets 89*a*, thereby increasing the toner concentration in the chamber.

FIG. 7A is a perspective view of the rear end wall 51 of the developing unit 40. As shown, various gears are mounted on the wall 51 at the rear of the revolver input gear 79. The shaft of the developing roller 84 extends throughout the wall 51 to the rear of the input gear 79. A gear 98 is mounted on the protruding end of the shaft of the roller 84. Likewise, the shafts of the screws 86 and 91 extend throughout the wall 51 to the rear of the input gear 79. Gears 99 and 100 are mounted on the protruding ends of the screws 86 and 91, respectively. An idle gear 101 is mounted on the rear of the wall 51 and held in mesh with the gears 98 and 100. An input gear 95 is also mounted on the rear of the wall 51 and engageable with the output gear 81. The revolver, carrying such gears on the wall 51 thereof, is received in the casing 46 and then inserted into the printer body, as stated earlier. As a result, the input gear 95 of the revolver is brought into mesh with the output gear 81 of the printer body, as shown in FIG. 7A. At the same time, the input gear 79 of the revolver meshes with the output gear 78 of the printer body.

Figure 8A:
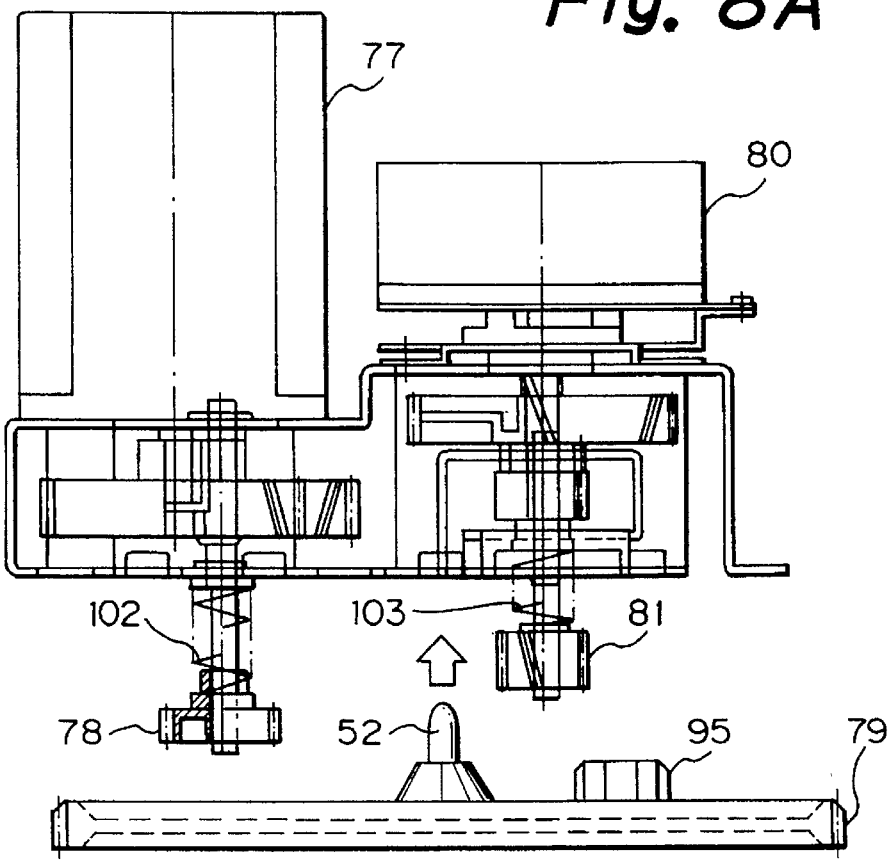
FIG. 8A shows a drive motor section included in the revolver.
Figure 8B:
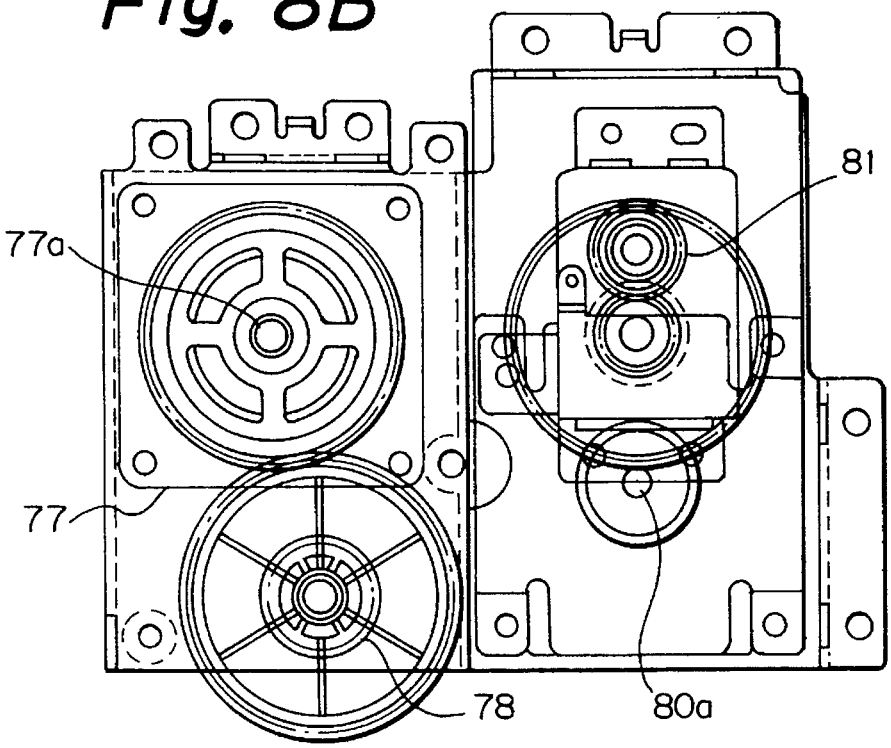
FIG. 8B is a front view of the motor section.

FIGS. 8A and 8B are respectively a plan view and a front view showing the drive motor portion of the revolver. As shown, the gears 78 and 81 of the printer body are retractable in the sliding direction of the casing 46, so that the gears of the printer body and those of the revolver can surely mate with each other when the casing 46 is inserted into the printer body. The gears 78 and 81 are constantly biased toward the printer body by springs 102 and 103, respectively. Hence, even when the gears 78 and 81 of printer body and the gears 79 and 95 of the revolver interfere with each other during the insertion of the casing 46, the gears 78 and 81 are retracted to ensure the insertion. Subsequently, the interference is cancelled due to the rotation of the gears 78 and 81. The gears 78 and 81 are pushed out by the springs 102 and 103 to the position closest to the revolver and, therefore, fully meshed with the gears 79 and 95.

FIG. 7A shows a condition wherein the gears stated above are in full mesh with each other. In this condition, the output gear 81 is rotated in a direction A with the result that the gears 99 and 100 are rotated via the input gear 95. The gears 99 and 100 cause the screws 86 and 91 to rotate. Further, the gear 98 is rotated via the input gear 95, gear 100 and idle gear 101 and, in turn, rotates the developing roller 84.

In the illustrative embodiment, to replace the developing section located at the developing position, the output gear 79 is rotated in a direction 13, FIG. 7A to thereby rotate the revolver in a direction C. Then, the roller 66 falls in one of the recesses 65 which is formed in the outer periphery of the rear end wall 51 of the revolver. Assume that the revolver has failed to rotate a desired angle (e.g. 90 degrees in the event of replacement of the developing section located at the developing position with another section just upstream of the former) due to irregularities in the motor 77 and irregularities in the load of the revolver. Then, the roller 66 fails to mate with the expected recess 65, i.e., to position the revolver. As a result, the distance between the developing roller 84 and the drum 1 differs from the target distance. To obviate this, the illustrative embodiment has the following implementation.

The embodiment controls the rotation of the motor 77 by using a control value matching a slightly greater angle (e.g. by about 3 degrees) than the desired angle in considerations of the irregularities mentioned above, thereby ensuring the rotation of the desired angle. Even when the revolver is rotated more than the desired angle due to such a control value, it can be accurately positioned on the basis of the moment of rotation to act on the revolver at the beginning of rotation of the motor 80. Specifically, as shown in FIG. 7A, the output gear 81 meshing with the input gear 95 of the developing section located at the developing position is rotated in the direction A (as during usual development). As a result, a moment of rotation acts on the revolver in a direction opposite to the direction (outline arrow D) in which the revolver usually rotates, thereby returning the revolver. At the same time, the return of the revolver is stopped as soon as the roller 66 falls in the particular recess 65, so that the revolver is locked in position. For this purpose, the position of the pin 63, supporting the bracket 64, and the position of the pin 63 relative to the revolver are determined such that the bracket 64 counteracts the rotation of the revolver in the returning direction. Further, when the revolver is rotated more than the desired angle due to the control value stated above, the roller 66 falls in the recess 65 and then leaves it. At this instant, it is preferable to reduce the load acting on the driveline. For this purpose, as shown in FIG. 7B, each recess 65 may be made up of two portions 65*a* and 65*b*; the portion 65*b* has a smaller inclination than the portion 65*a*. The roller 66 easily leaves the recess 65 via the portion 65*a* during usual revolution. The other portion 65*b* is used to lock the revolver.

As shown in FIG. 5, the yellow developing unit, for example, has the developing roller 84Y and doctor blade 85Y supported by front and rear small wall pieces 104 which are separable from the other front and rear wall portions. When the chamber should be cleaned or when the parts should be replaced, the small wall pieces 104, carrying the roller 84Y and blade 85Y therewith, can be bodily removed to facilitate the access to the chamber.

Figure 7C:
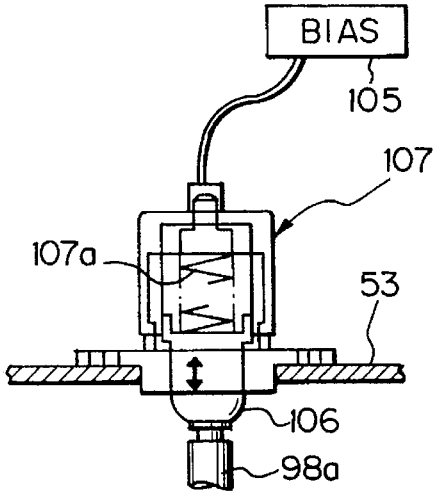
FIG. 7C is a section showing a modification of the revolver.

As shown in FIG. 7C, a bracket 107 is mounted on the printer rear panel 53 at a position facing the developing roller shaft 98*a* when the shaft 98*a* is brought to the developing position. A rod-like terminal 106 is supported by the bracket 107 in such a manner as to be retractable in the sliding direction of the casing 46. A spring 107*a* constantly biases the terminal 106 forward. The terminal 106 has a hemispherical tip. The end of the developing roller 84 is formed with a recess slightly greater in diameter than the hemispherical tip of the terminal 106 and having an arcuate cross-section. When the end of the shaft 98*a* is brought into or out of alignment with the terminal 106 during the rotation of the revolver, the end of the shaft 98*a* and the tip of the terminal 106 are allowed to engage and disengage with a minimum of contact load acting thereon and to remain in contact stably.

Figure 9:
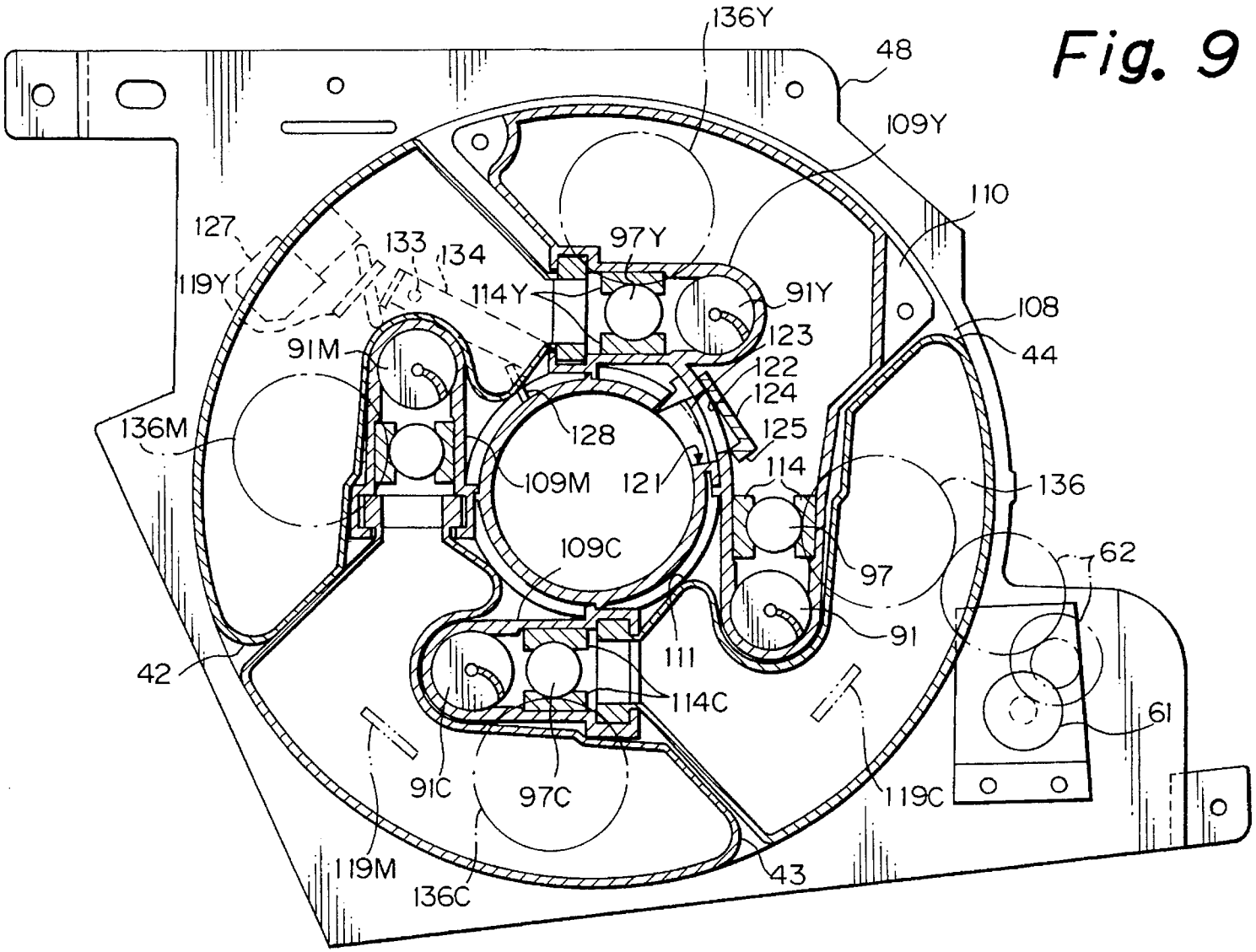
FIG. 9 is a section along line Y—Y of FIG. 3.

FIG. 9 is a section along line Y—Y of FIG. 3 and showing the internal arrangement of the toner storing unit 45. The section is also representative of a condition wherein the black developing unit is located at the developing position. As shown, the storing unit 45 has a disk-like base plate 108 (see also FIG. 2). Four receptacles, or cases, 109Y, 109M, 109C and 110 are affixed to the front end of the base plate 108, and each corresponds to one of the chambers of the developing unit 40. Toner supply rollers 97Y, 97M, 97C and 97 are disposed in the receptacles 109Y, 109M, 109C and 110, respectively. The rollers 97Y–97 are journalled to the base plate 108 and the front walls of the associated receptacles 109Y–110 such that they will be each positioned substantially just above the extension of the screw 91 when the corresponding chamber is brought to the developing position.

The base plate 108 is formed with a circular through hole 111 at the center thereof. The hole 111 allows the cylindrical black toner container (see FIGS. 12A and 12B) to be passed therethrough. The receptacles 109Y–110 are so positioned as not to interfere with the holes assigned to the lower screws 91 extending out from the developing chambers, and holes assigned to trough-like screw covers 112 (see FIG. 10) which are optional parts. The screws 91 each extends into one of the receptacles 109Y–110 via the base plate 108.

Figure 10:
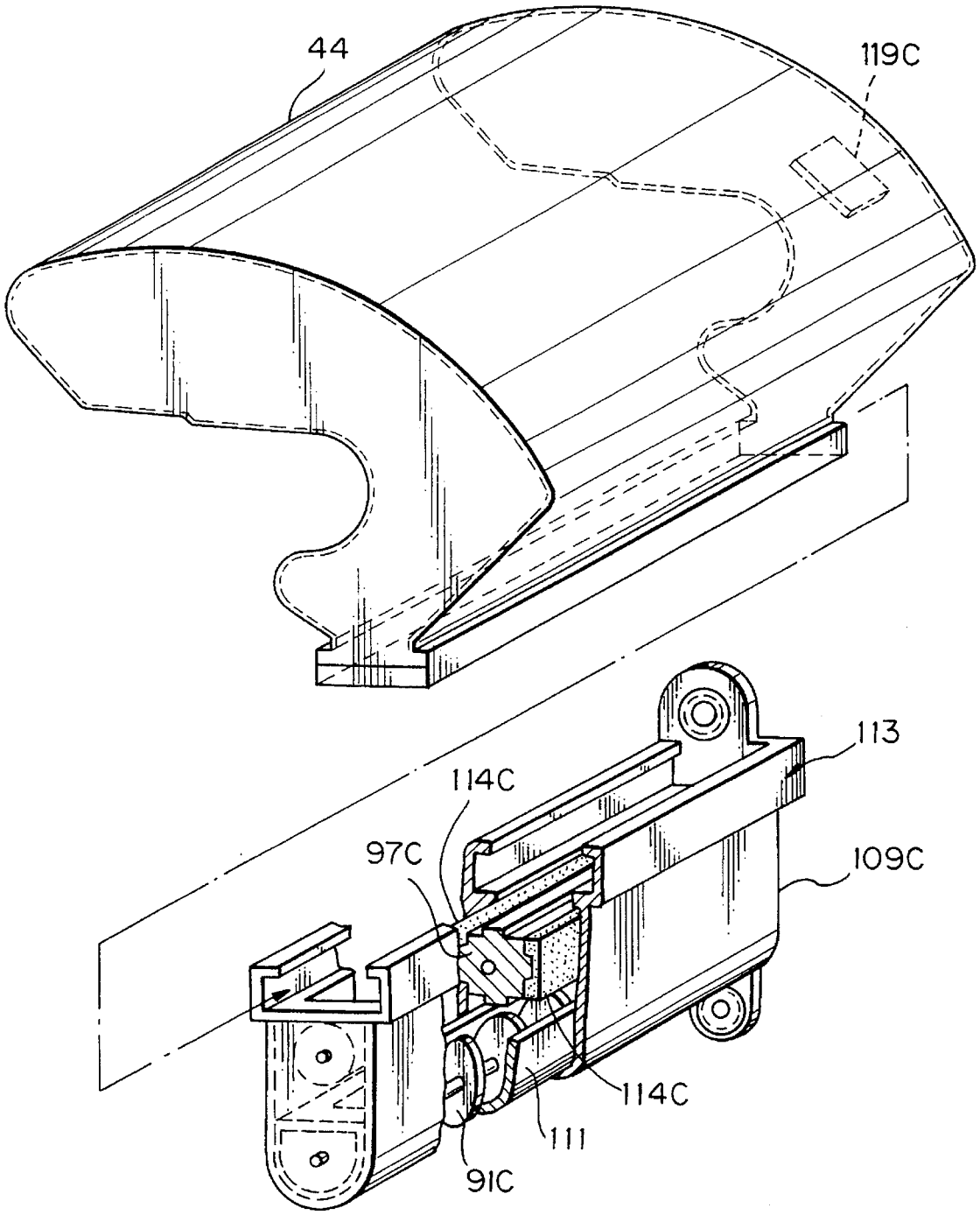
FIG. 10 is a perspective view of a color toner container and a mount portion therefor included in the revolver.

FIG. 10 shows the receptacle 109C assigned to the cyan toner, and the cyan toner container 44. The receptacles 109Y, 109M and 109C have an identical configuration. The receptacle 109C, for example, has a wall surrounding the portion of the lower screw 91 present in the receptacle 109C. The wall is formed with a toner inlet at such a position that the inlet overlies the toner supply roller 97C when the assigned chamber is located at the developing position. The inlet is surrounded by a mount portion 113. The cyan toner container 44 is mounted to the mount portion 113 with the outlet thereof facing downward, by being slid in the axial direction of the revolver. Seal members 114C are fitted on part of the inner periphery of the receptacle 109C which face the roller 97C. The seal members 114C and roller 97C divide the interior of the mouth portion 113 into two portions respectively adjoining the toner container 44 and the chamber. In addition, the seal members 114C and the wall, surrounding the roller 97C and screw 91C, define the previously mentioned communication chamber which is communicated to the associated developing chamber via the hole of the base plate and drop section.

Figure 11A:
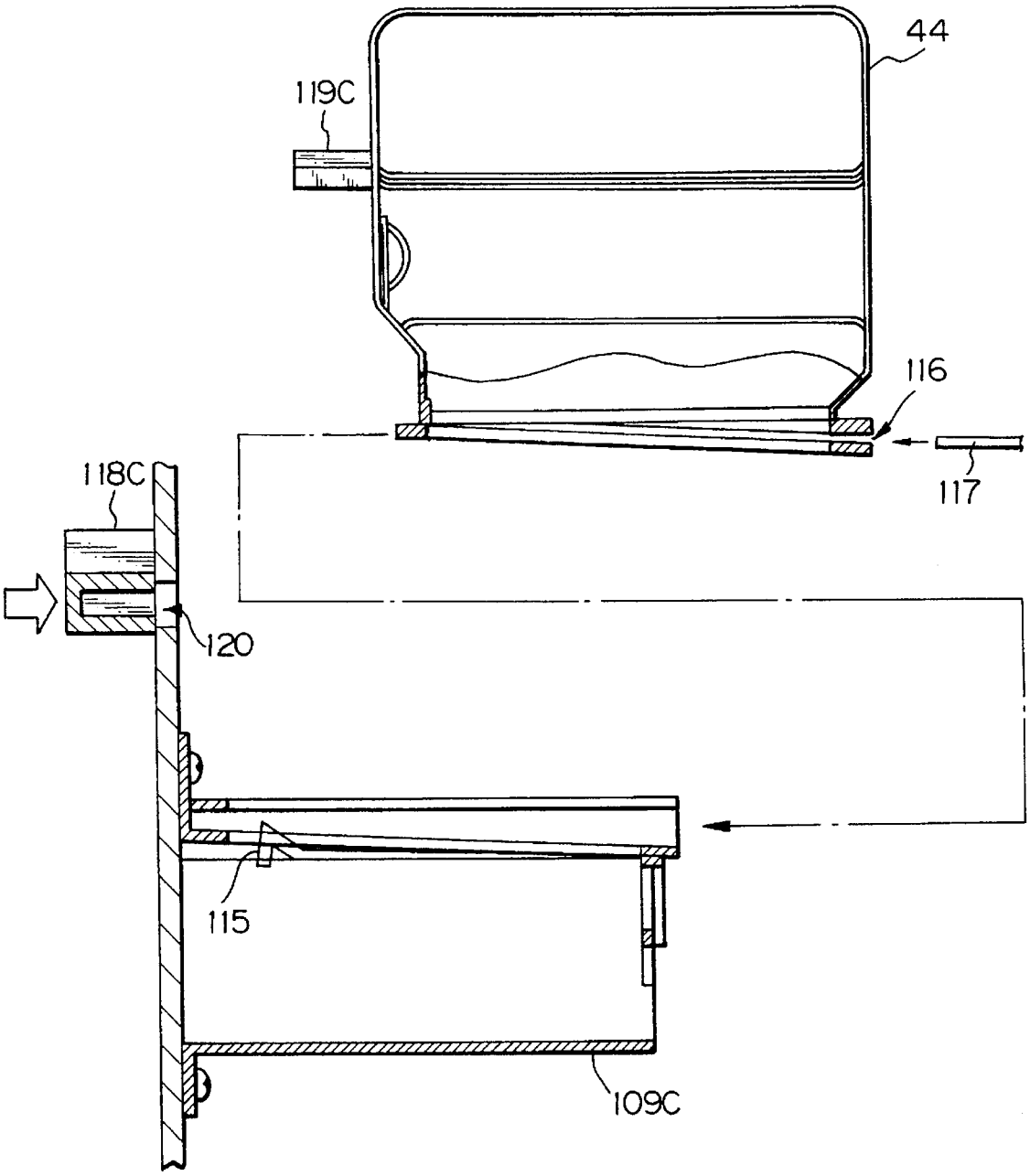
FIG. 11A demonstrates how the container is mounted to the mount portion.

As shown in FIGS. 10 and 11A, the mount portion 113 is configured such that the associated color toner container can be mounted and dismounted by being slid in the axial direction of the revolver. A safety member 115 (see FIG. 11A) is provided on the mount portion 113 and protrudes into the toner container via a toner outlet. The safety member 115 prevents the toner container from being pulled out when it is simply slid in the opposite direction, i.e., toward the operator. A slit 116 is formed in the outlet portion of the toner container. To remove the toner container from the mount portion 113, a shutter member 117 is inserted into the slit 116 to push the safety member 115 out of the toner container. When a new color toner container whose toner outlet is closed by a seal member is to be mounted to the mount portion 113, it is preferable to slide it on the portion 113 and then remove the seal member to uncover the toner outlet.

In the event of replacement of the color toner container, the cover 47, FIG. 2, plays the role of a member for regulating the position for replacement or replacing position. Specifically, as shown in FIG. 2, the cover 47 is positioned at the downstream side with respect to the direction in which the container is pulled out from the storing section 45. The cover 47 has a removed portion 47*a* and allows the container to be pulled out only through this portion 47*a*. Part of the removed portion 47*a* formed in the end wall consists of three contiguous portions, i.e., a center portion assigned to the black toner container set along the axis of the revolver, a notch 130 assigned to a lug 128 provided on the black toner container, as will be described, and a peripheral portion assigned to a single color toner container. In the embodiment, when one of the developing sections is located at the developing position, the color toner container corresponding to the developing section is aligned with the peripheral portion mentioned above. Hence, as FIG. 9 indicates, the inlet of the mount portion 113 on which the container ready to be pulled out via the peripheral portion faces upward. In this condition, even if the toner is present in the vicinity of the inlet of the mount portion 113 when the container is pulled out, it is prevented from being scattered around via the inlet.

Assume that the shutter member 117, FIG. 11A, is not used in the event when the loner container is pulled out, or that toner is apt to gather around the outlet of a color toner container in a great amount due to a particular configuration and partly turns around to the outside of the shutter member 117. Then, it is likely that the toner dropping from the outlet of the container, which faces downward in the event of replacement, is more critical than the toner leaking from the inlet of the mount portion 113. In such a case, it is preferable that the peripheral portion assigned to the color toner container be so formed as to align with the color toner container whose outlet faces upward (magenta toner container 43 in FIG. 9).

The toner, whether it be color toner or black toner, is apt to cohere in the vicinity of the outlet of the container. If the container with the cohered toner is pulled out, the toner is apt to drop and smear the surrounding. In the light of this, the embodiment loosens the toner before replacement and transfers the loosened toner to the toner receiving case. Moreover, in a toner near end condition, the embodiment controls the rotation of the revolver such that the container which should be replaced is automatically moved to the replacing position, as will be described specifically later.

Figure 11B:
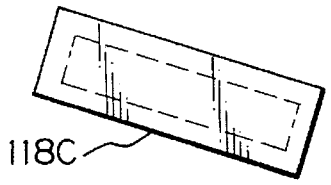
FIG. 11B shows a set sensor responsive to the container.

The color toner containers 42, 43 and 44 are each configured to engage with the wall, surrounding the lower screw 91, of one of the receptacles located upstream of the corresponding receptacles with respect to the direction of rotation of the revolver. Lugs 119Y, 119M and 119C are respectively formed on the outer surface of the base plate. A set sensor 118C, shown in FIGS. 11A and 11B by way of example, senses the lugs 119Y–119C. Specifically, set sensors 118Y, 118M and 118C are mounted on the rear of the base plate and implemented by reflection type or transmission type optical sensors. The sensors 118Y–118C are respectively responsive to the ends of the lugs 119Y–119C extending throughout and to the rear of the base plate.

As shown in FIG. 9, the receptacle 110 assigned to the black chamber has a wall substantially identical with the contour of the color toner receptacle 109Y, 109M or 109C and color toner container 42, 43 or 44 mounted thereto. Seal members 114 are fitted on the inner periphery of the portion of the receptacle 110 corresponding to the receptacle. Also, the seal members 114 define a communication chamber communicated to the associated developing chamber in cooperation with the wall surrounding the screw 91. The wall portion similar to the color toner container is formed with a toner inlet 122 in a portion thereof which faces the center line of the revolver. The toner inlet 122 is identical in shape with the toner outlet 121 of the container 41 shown in FIGS. 12A and 12B. Black toner received from the container 41 via the inlet 122 accumulates in the wall portion similar to the color toner container, and a portion surrounded by the roller 97 and adjoining part and corresponding to the hopper of a conventional toner replenishing device. The black toner is conveyed from such portions to the communication chamber by the roller 97. A shutter 124 is rotatably supported at one end by a shaft 123 parallel to the axis of the revolver. The inlet 122 can be closed by the shutter 124 at the inside of the receptacle 110. Specifically, the shutter 124 angularly moves about the shaft 123 due to its own weight while the revolver is in revolution, thereby automatically opening and closing the inlet 122. A seal member 125 is fitted on the edge of the shutter 124.

Figure 13A:
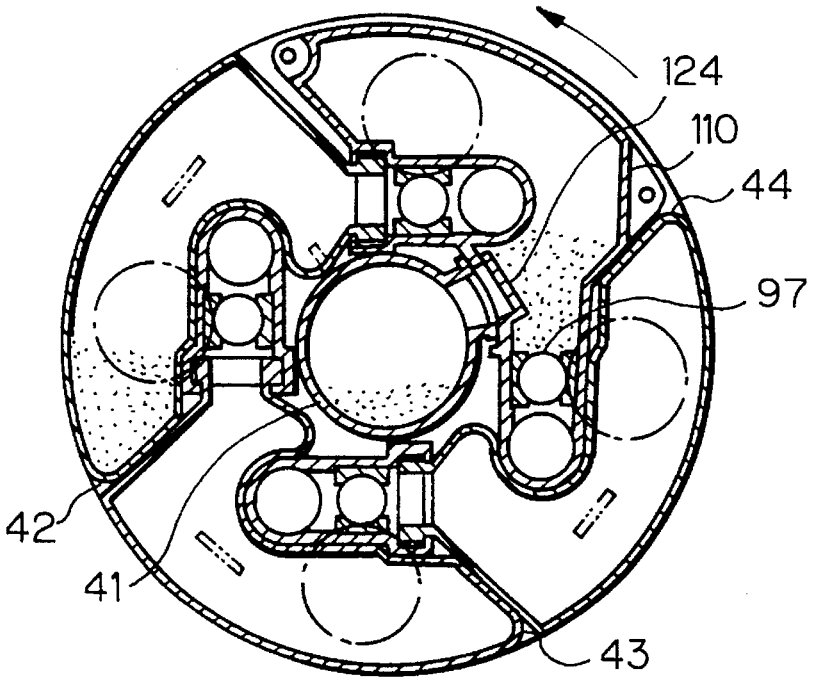
FIGS. 13A–13D show the behavior of toner to occur when the revolver is in rotation.

FIGS. 13A–13D demonstrate how the toner in each of the toner containers 41–44 and black toner receptacle 110 moves when the revolver rotates in a direction indicated by an arrow. Because the color toner containers 42–44 are identical in respect of the movement of the toner, only the toner in the yellow toner container 42 is shown. As for the black toner, when the black chamber is located at the developing position, the toner in the receptacle 110 moves downward due to its own weight while being guided by the wall of the receptacle 110, as shown in FIG. 13A. The black toner accumulates in the lower portion of the receptacle 110 above the toner supply roller 97 and corresponding to a conventional hopper. Hence, the black toner is ready to be fed to the communication chamber where the lower screw 91 is present. At this instant, the outlet 121 of the black toner container 41 faces upward, preventing the black toner from being fed into the receptacle 110. Also, the shutter 124 prevents the black toner from flowing from the receptacle 110 into the container 41.

Figure 12A:
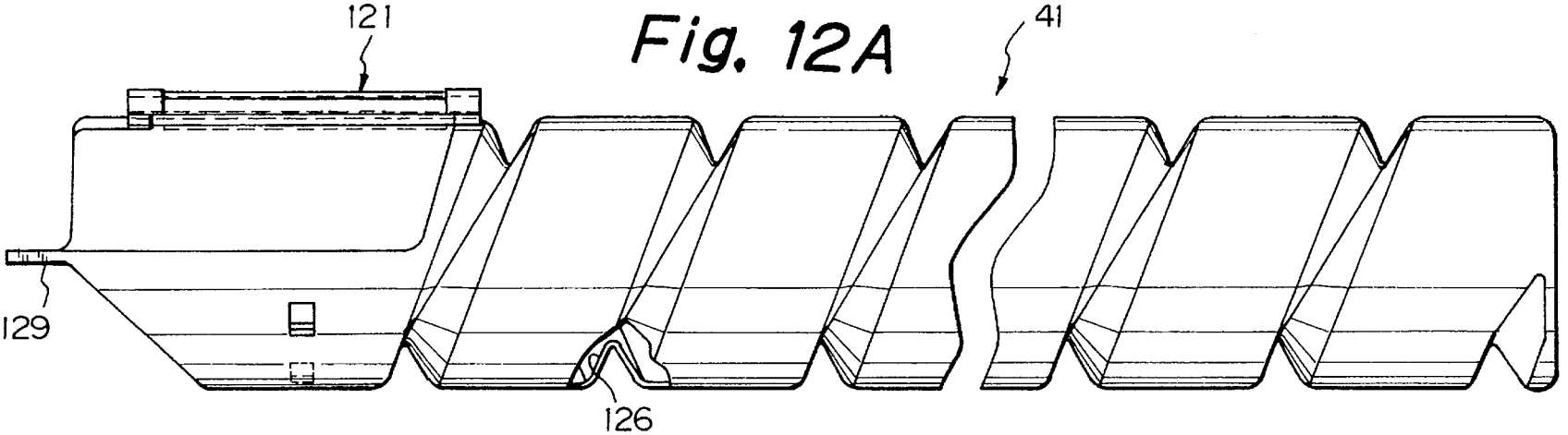
FIG. 12A is a side elevation of a black toner container included in the revolver.
Figure 12B:
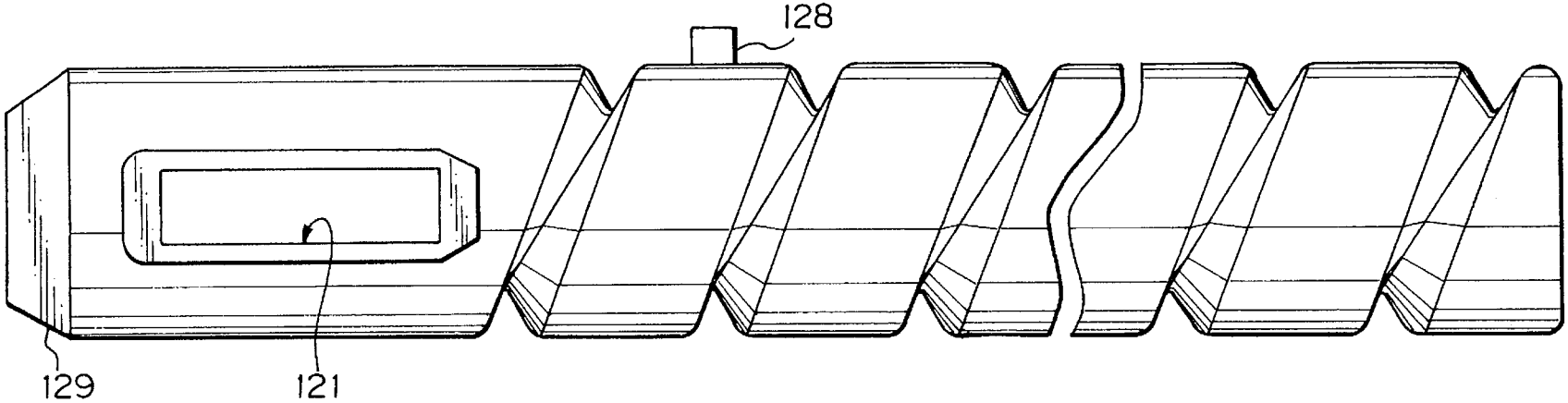
FIG. 12B is a front view of the black toner container.
Figure 13B:
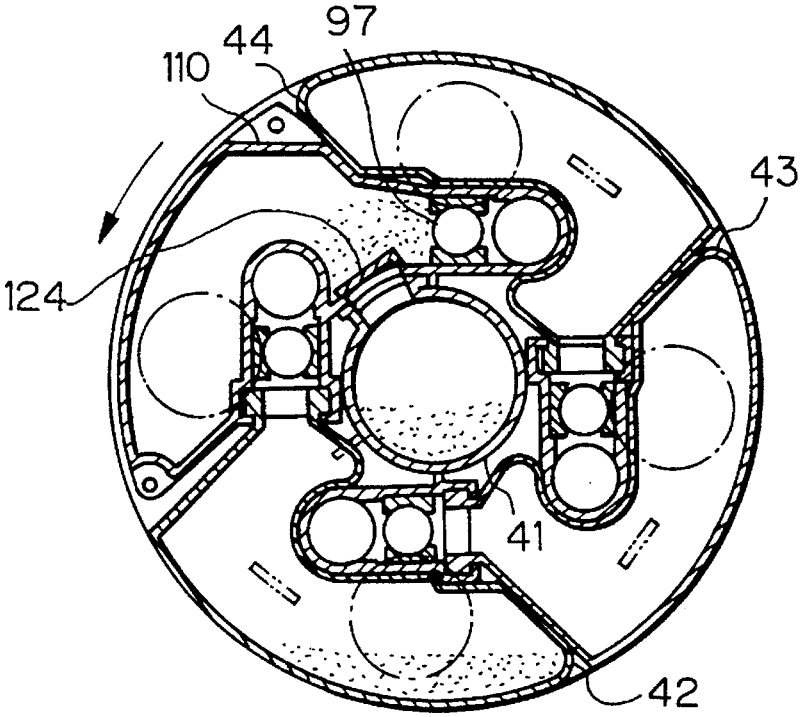
Figure 13C:
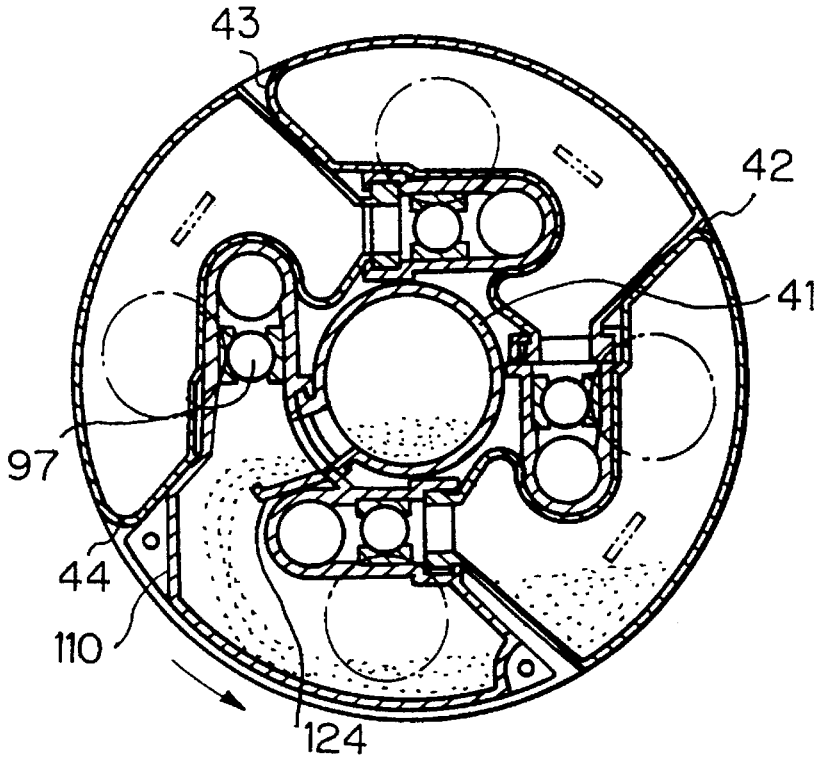
Figure 13D:
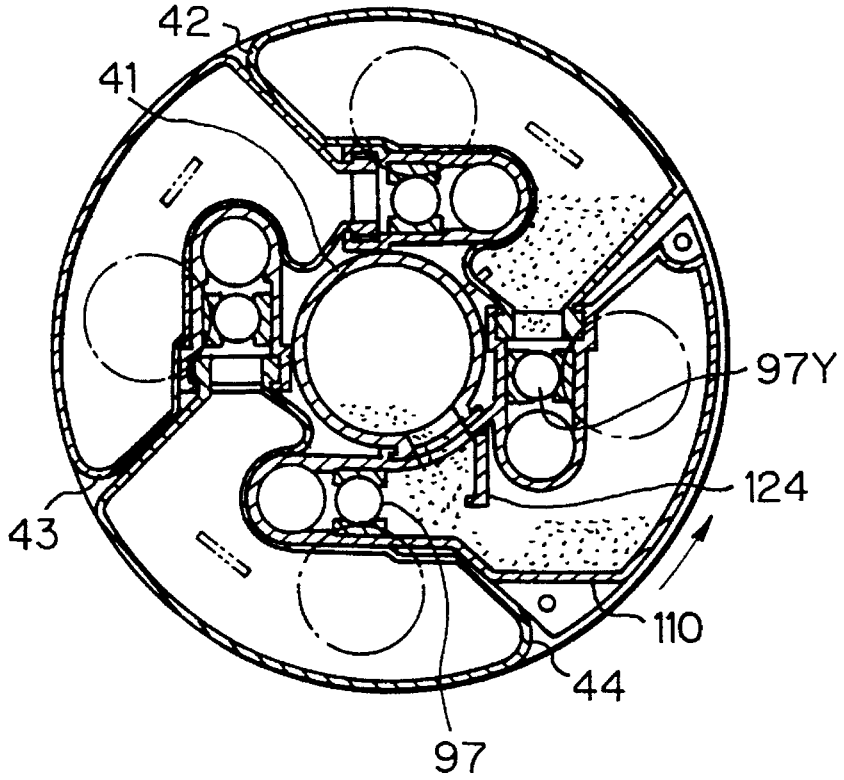

As shown in FIG. 13B, when the revolver rotates 90 degrees to bring the cyan developing chamber to the developing position, the black toner sequentially moves from the position adjoining the roller 97 toward the inlet 122 located below and at the left of such a position. As shown in FIG. 13C, when the revolver further rotates 90 degrees until the magenta developing chamber reaches the developing position, the shutter 124 opens by rotating about the shaft 123 due to its own weight. At the same time, the black toner adjoining the outlet 121, FIGS. 12A and 12B, starts moving into the receptacle 110 due to its own weight. When the revolver further rotates 90 degrees until the yellow developing chamber arrives at the developing position, the black toner is further transferred to the receptacle 110, i.e., most of the toner around the outlet 121 is transferred to the receptacle 110. At this instant, the toner in the yellow toner container 42 moves onto the toner supply roller 97Y due to its own weight while being guided by the wall of the container 42. In this condition, the yellow toner is ready to be supplied to the associated communication chamber where the lower screw 91Y is present. In this manner, while the outlet 121 of the container 41 is positioned above the inlet 122 (FIGS. 13A and 13B), the inlet 122 is opened to receive the toner. However, when the inlet 122 is positioned above the outlet 121 (FIGS. 13C and 13D), the inlet 122 is closed to prevent the toner from being returned to the container 31.

As shown in FIG. 10, the toner supply rollers 97Y–97 each includes a portion where a plurality of axial grooves are formed in the outer periphery. As shown in FIG. 3, a gear 135 is mounted on the end of a shaft extending throughout the base plate 108 toward the developing unit 40. An input gear 136 is held in mesh with the gear 135. The gears 135 and 136 are assigned to each of the rollers 97Y–97. As shown in FIG. 9, when one developing section or chamber of the developing unit 40 is brought to the developing position, the input gear 136 corresponding to the developing chamber is brought into mesh with the gear 62 which is driven by the motor 61. Toner replenishment control associated with the motor 61 will be described later.

As shown in FIGS. 12A and 12B, the black toner container 41 has the outlet 121 formed in the circumferential wall of one end portion thereof. A spiral ridge 126 is formed in the inner periphery of the container 41 from the end remote from the outlet 121 toward the outlet 121. When the container 41 is mounted to the revolver, the ridge 126 rotates integrally with the revolver so as to feed the toner from the rear end toward the outlet 121. A lug 128 is provided on the outer periphery of the container 41 at the rear of the outlet 121. A grip portion 129 is provided on the front end of the container 41. A set sensor 127 is mounted on the revolver, i.e., the rear of the front support wall 48 of the casing 46. A link 134 is rotatably mounted on tile rear of the support wall 48 by a shaft 133. The lug 128 is sensed by the set sensor 127 via the link 134.

Specifically, the cover 47, FIG. 2, is formed with a notch 130 and a notch 47*a* for the insertion of the container 41. The container 41 is positioned such that the outlet 121 faces upward. After the seal member closing the outlet 121 has been removed, the container 41 is inserted into the revolver through the notch 47*a* with the lug 128 thereof aligned with the notch 130. The container 41 is inserted to the deepest position where the rear end is received in the hollow cylindrical portion 82 of the developing unit 40, and where the front end is substantially flush with the front of the front walls of the cases of the toner storing unit 40, as indicated by a phantom line in FIG. 3. Then, the container 41 is rotated clockwise, as viewed in the figures, about its own axis with the grip portion 129 held by hand, until the outlet 121 aligns with the inlet 122. At this instant, the lug 128 raises the link 134 and causes it to rotate. As a result, the set sensor 127 senses the container 41 via the link 134.

The angular position of the black toner container 41 for replacement is also regulated by the cover 47. In the removed portion 47*a*, the center portion assigned to the container 41 has a sufficient size without regard to the angular position thereof. The notch 130 contiguous with the removed portion 47*a* restricts the position of the container 41 in cooperation with the lug 128 provided on the container 41. Specifically, the container 41 cannot be pulled out unless it is rotated to bring the lug 128 into alignment with the notch 130. The container 41 is rotatable about 45 degrees relative to the revolver in the same manner as during insertion. When the container 41 is rotated clockwise to the limit position within the rotatable range, the outlet thereof coincides with the inlet of the receptacle 110. Marks 132 and 131 are respectively provided on the receptacle 110 and the container 41 and align with each other when the container 41 is brought to the limit position. Therefore, the revolver should only be rotated to a position where, when the container 41 is located at the limit position, the lug 128 is positioned 45 degrees downstream of the notch 130 in the clockwise direction, i.e., the black chamber corresponding to the container 41 is located at the developing position, as has been the case with the color toner containers. While the revolver is held in this position, the container 41 is rotated 45 degrees counterclockwise with the grip portion 129 held by hand, causing the lug 128 to align with the notch 130. The operation for loosening the cohered toner and the rotation of the revolver for automatically locating the container at the position for replacement are also executed with the container 41, as will be described later.

Figure 14A:
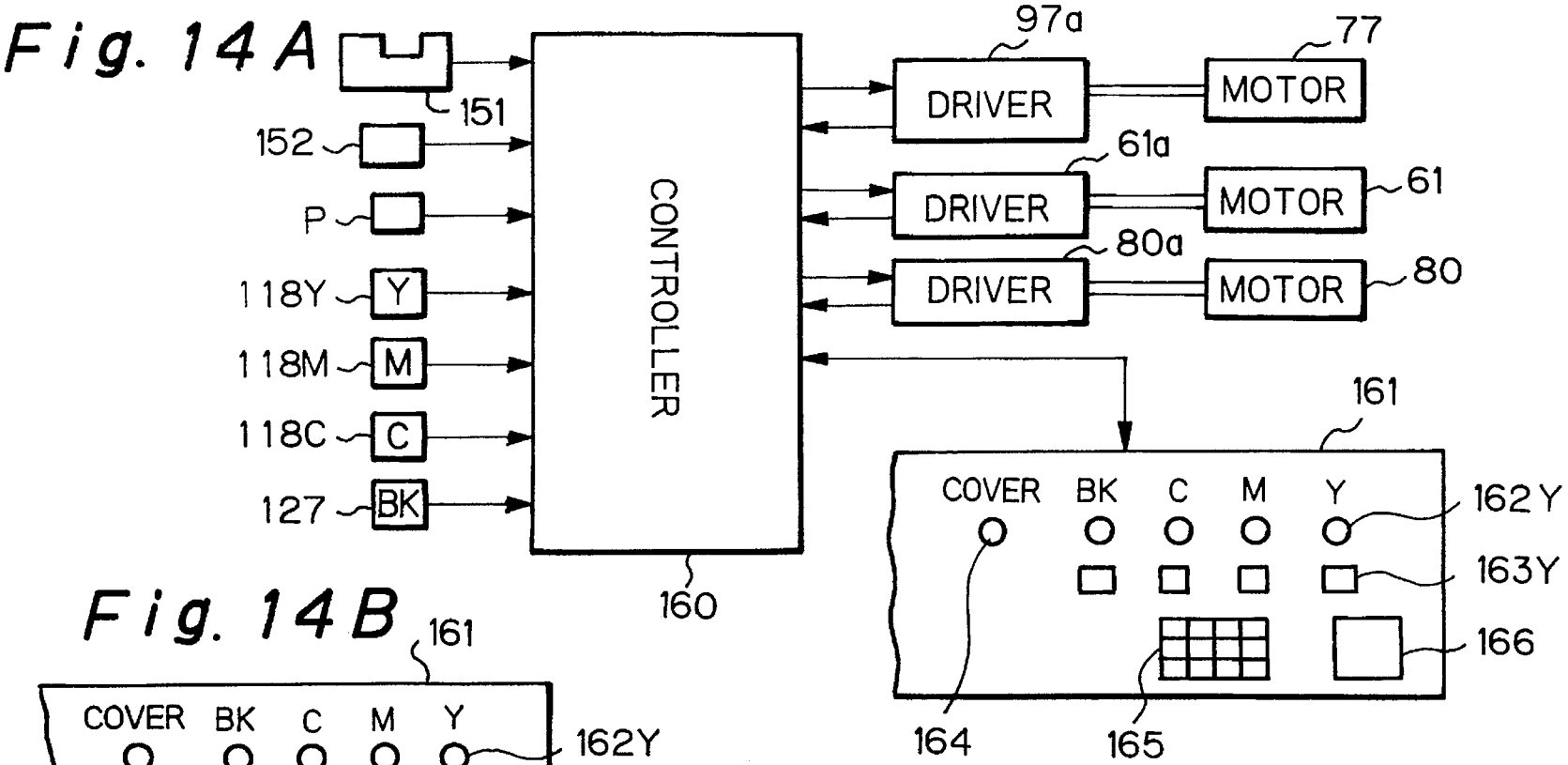
FIG. 14A is a block diagram schematically showing a control system built in the printer.

Referring to FIG. 14A, a control system included in the printer body is shown. As shown, the system has a controller 160 consisting of a CPU (Central Processing Unit), RAM (Random Access Memory), ROM (Read Only Memory), I/O (Input/Output) interface, timer and so forth, although not shown in the figure. Connected to the CPU via the I/O interface are a home position sensor 151, a front cover sensor 152, an optical sensor P for toner density control (see FIG. 1), set sensors 118Y, 118M, 118C and 127 responsive to the respective toner containers, motor drivers 77*a*, 61*a* and 80*a* for respectively driving the motors 77, 61 and 80, an operation panel 161, etc. The operation panel 161 has lamps 162Y, 162M, 162C and 162BK for informing the user of the toner near end conditions of the respective developing sections, buttons 163Y, 163M, 163C and 163BK for allowing the user to command the replacement of the toner containers 41, 42, 43 and 44, a lamp 164 for reporting the user the opening of a front cover, numeral keys 165, a print start button 166, etc.

As shown in FIG. 3, the home position sensor 151 is mounted on, for example, the front support wall 48 of the casing 46 in order to sense a member 150 provided on the revolver. The output of the sensor 151 is used for the initialization immediately after the power switch of the printer has been turned on and for the movement control following a printing operation. Specifically, the revolver is held at the home position where the sensor 151 senses the member 150, e.g., where the black developing unit is located at the developing position, as shown in FIGS. 5 and 9, after the initialization and during stand-by period after a printing operation.

Figure 14B:
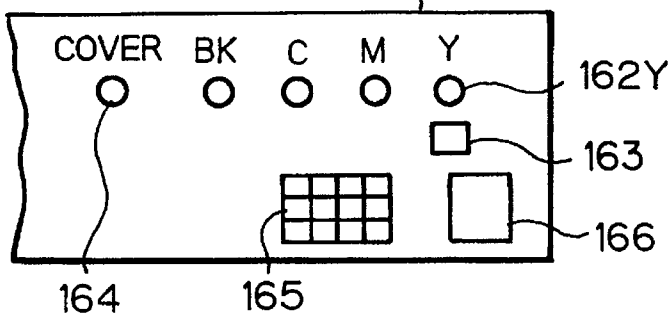
FIG. 14B is a plan view showing a modification of an operation panel included in the control system.

FIG. 14B shows a modification of the operation panel 161. As shown, the panel 161 is provided with a single command button 163 in place of the buttons 163–163BK shown in FIG. 14A. With this panel 161, the operator simply enters a replacement command on the button 163 without specifying any of the containers 41–44.

Further, in the illustrative embodiment, a reference toner image representative of a reference pattern is formed on the drum in order to sense the density thereof. A change in the toner concentration of the developer in each developing chamber is detected in terms of a change in the density of the reference toner image. Toner is replenished into the associated developing chamber on the basis or the image density, thereby maintaining the toner concentration constant.

Specifically, after the drum 1 has been uniformly charged by the main charger 2, the laser optics 3 scans the drum 1 in accordance with image data representative of the reference pattern. The resulting latent image is developed by the revolver 4 to turn out the reference toner image. A reflection type optical sensor P (see FIG. 1) is located downstream of the revolver 4 in the direction of rotation of the drum 1 and senses the reference toner image. The sensor P is made up of a light emitting diode and a phototransistor.

The formation of the reference toner image on the drum 1 and the measurement of the image density by the sensor P are effected for the first printing after the shipment of the printer (i.e. after the RAM has been cleared), and every time ten printings are produced after the first printing. When the output $V_{SP}$ of the sensor P is equal to a reference value $V_{SPO}$, the toner concentration of the developer is determined to be adequate. If $V_{SP}$ is lower than $V_{SPO}$, the toner concentration is determined to be high, so that no toner is replenished. Conversely, if $V_{SP}$ is higher than $V_{SPO}$, the toner concentration is determined to be low. In this case, the motor 61 for driving the toner supply roller 97 is energized for a predetermined period of time every time one printing is produced, up to the time for the next measurement. As a result, fresh toner is replenished into the communication chamber from the toner container 41, 42 or 43 or from the receptacle 110.

The toner replenished into the communication chamber is conveyed to the drop section by the lower screw 91. At the drop section, the toner is mixed with the developer dropped from the upper screw 86. The mixture is conveyed into the effective width of the developing roller, thereby increasing the toner concentration in the developing chamber.

Assume that the toner concentration of the developer is determined to be low a plurality of consecutive times (e.g. three times) by the toner concentration control. Then, it is determined that the developing chamber is in a toner near end condition, and one of the lamps 162 assigned to the chamber is turned on. After the turn-on of the lamp 162, ten more printings can be produced by the developing chamber. After ten more printing have been produced or when the command button 163 is pressed, a preparatory procedure for replacing the toner container corresponding to the developing chamber is automatically executed. The preparatory procedure includes moving the toner container to the replacing position, and loosening the toner cohered at the outlet of the container. Of course, after the turn-on of the lamp 162, the preparation may be executed while inhibiting further printings.

Figure 15A:
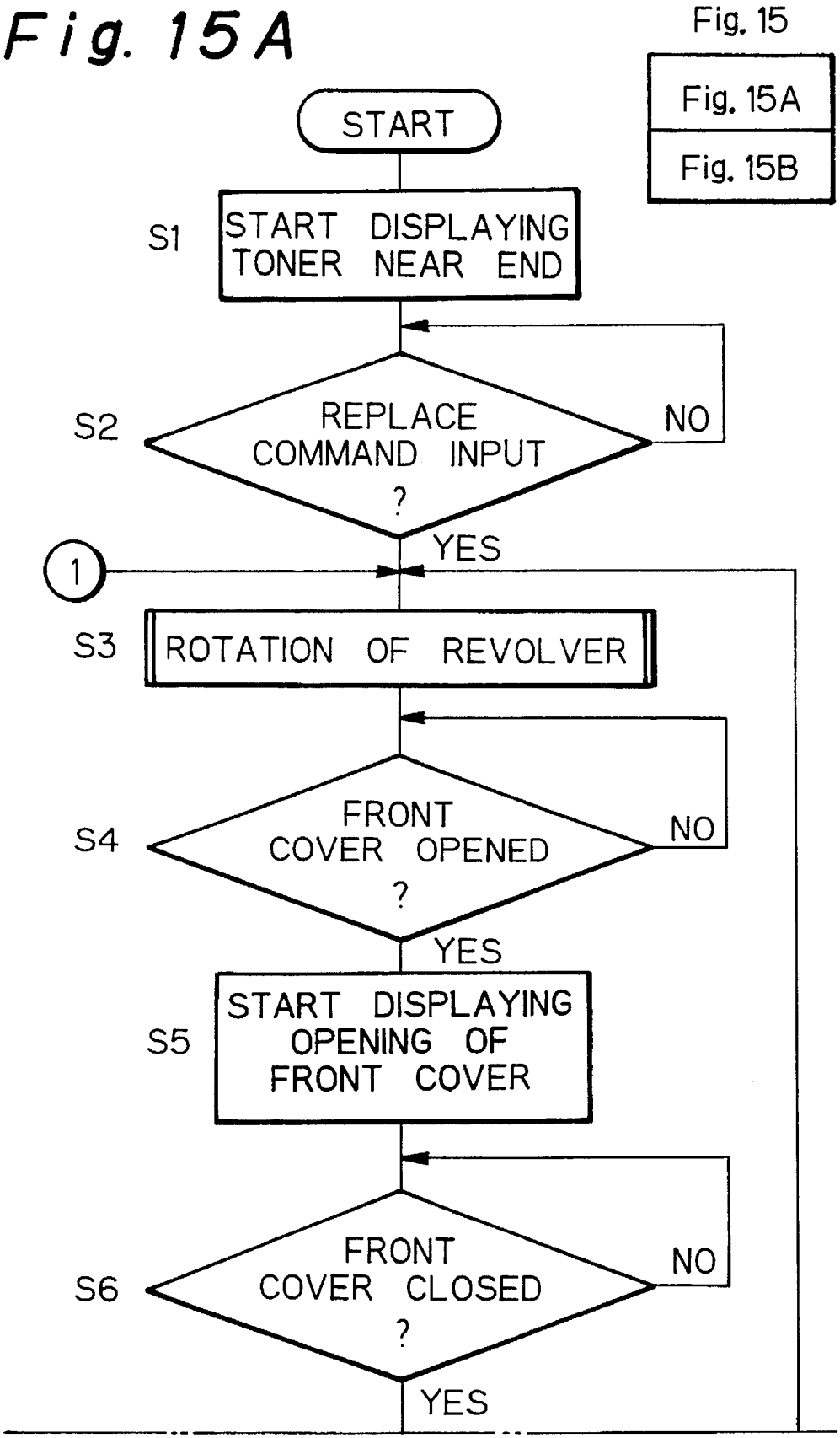
FIGS. 15A and 15B is a flowchart demonstrating a specific operation of the control system.
Figure 15B:
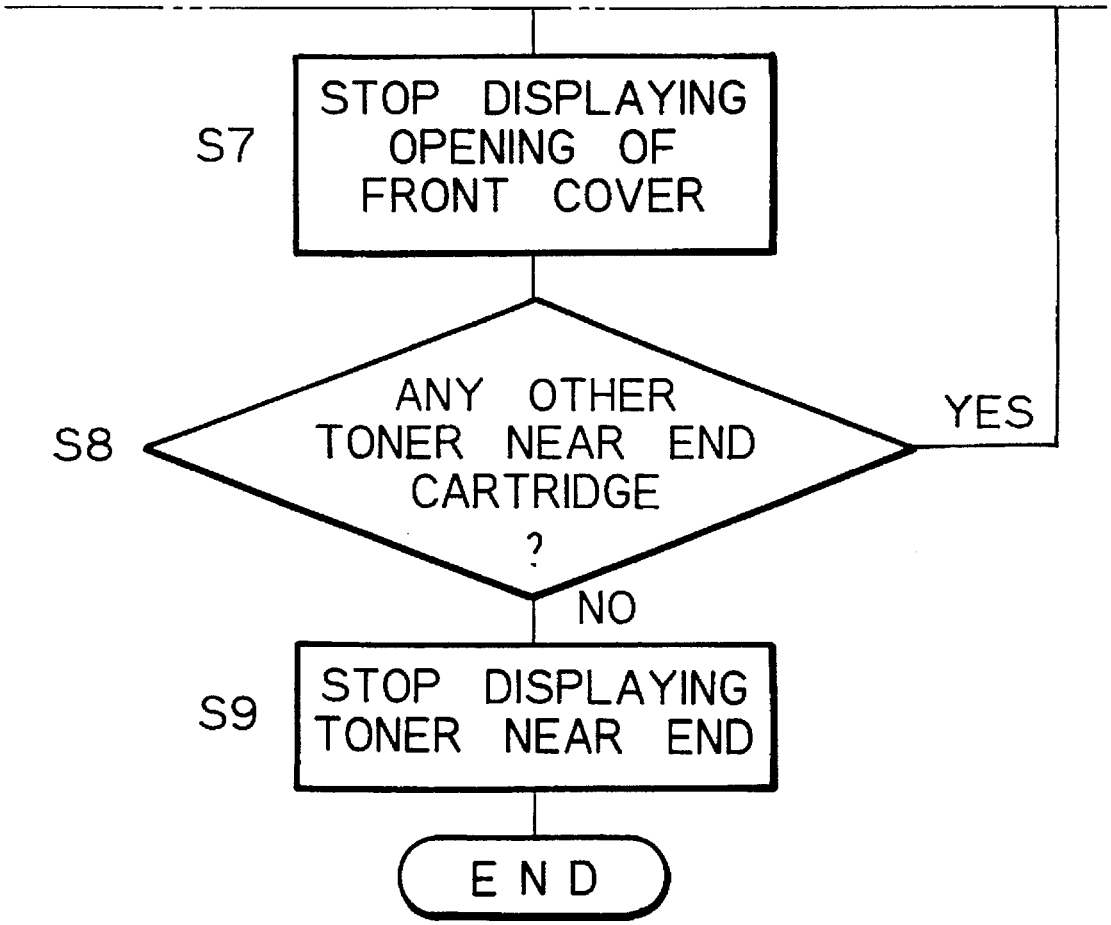

Referring to FIGS. 15A and 15B, a specific routine for moving the container reached the toner near end condition to the replacing position in response to the command will be described. Assume that the routine is executed with the modified operation panel 161 shown in FIG. 14B, i.e., it accepts only a replace command entered on the button 163. Specifically, even when two or more of the containers reach the toner near end condition, the routine does not accept the selection or the priority of the containers.

First, the controller 160 causes the toner near end condition to be displayed (step S1) and awaits a replace command (step S2). On the input of a replace command, the controller 160 sets up a condition for rejecting a print command, and then causes the revolver to rotate for locating the empty container to the replacing position. When two or more containers emptied at the time of input of the replace command, the controller 160 brings one of them whose current position is closer to the replacing position on the rotation path of the revolver in the usual direction to the replacing position (step S3). After the front cover of the printer has been opened (YES, step S4), the controller 160 starts displaying the opening of the front cover (step S5). Alter the front cover has been closed (YES, step S6), the controller 160 stops displaying the opening of the front cover (step S7). The controller 160 determines that the container has been replaced on the basis of the opening and the following closing of the front cover. Subsequently, the controller 160 references a flag or the like to see if any other container is in the toner near end condition or not (step S8). If the answer of the step S8 is NO, the controller 160 stops displaying the toner near end condition (step S9) and returns to the tep S3. If the answer of the step S8 is YES, the controller 160 returns to the step S3. The controller 160 repeats the above procedure until the answer of the step S8 changes from YES to NO.

While the specific routine described above detects the end of replacement on the basis of the opening and closing of the front cover, it may be modified to detect it in response to the output of the set sensor 118Y, 118M, 118C or 127. Further, when the printing operation is inhibited after ten more printings have been produced, as stated earlier, the controller 160 may directly enter the routine at the step S3, as indicated by circled numeral 1 in FIGS. 15A and 15B.

Figure 16A:
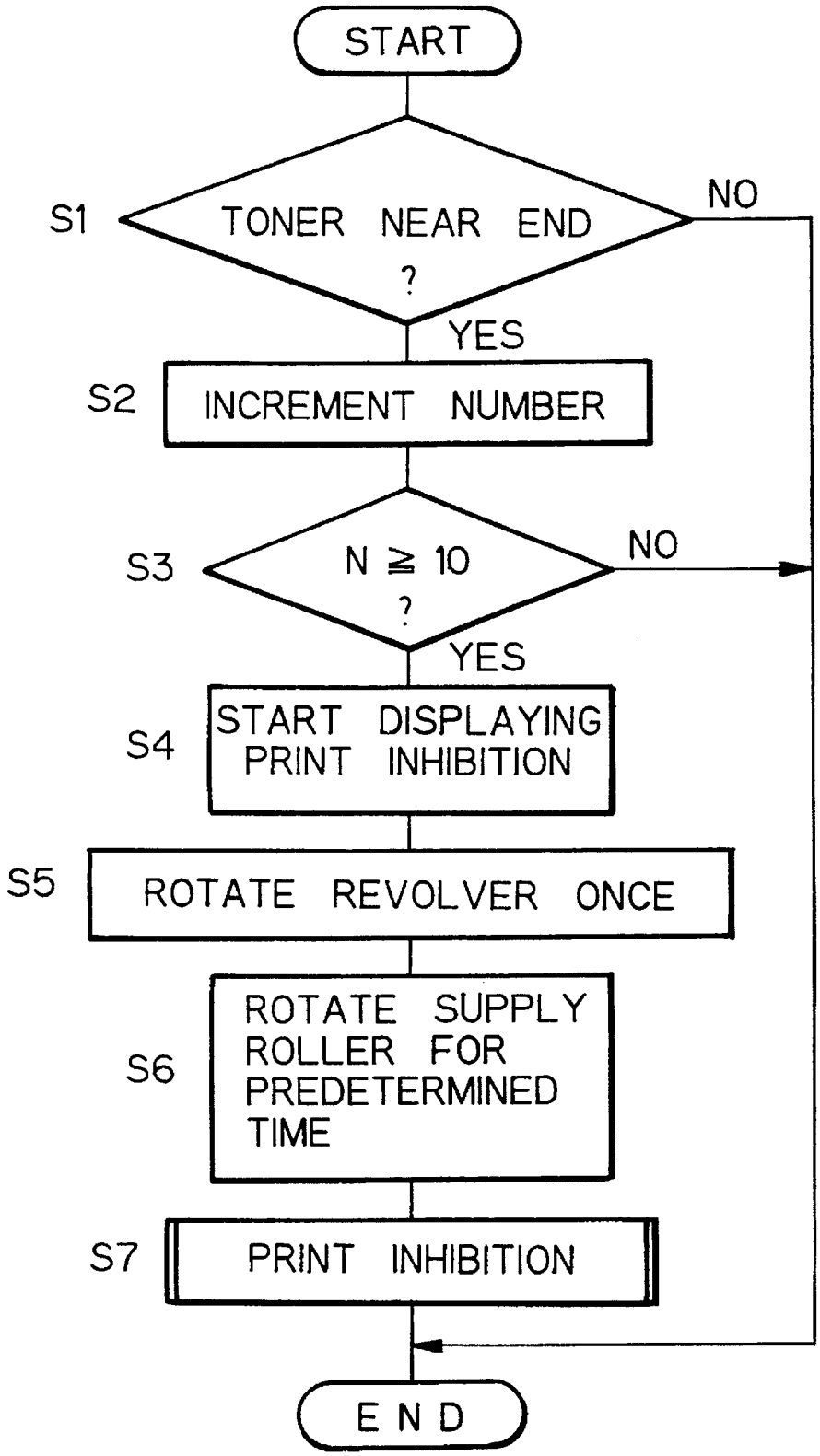
FIGS. 16A and 16B each shows another specific operation of the control system.
Figures 1, 16B:
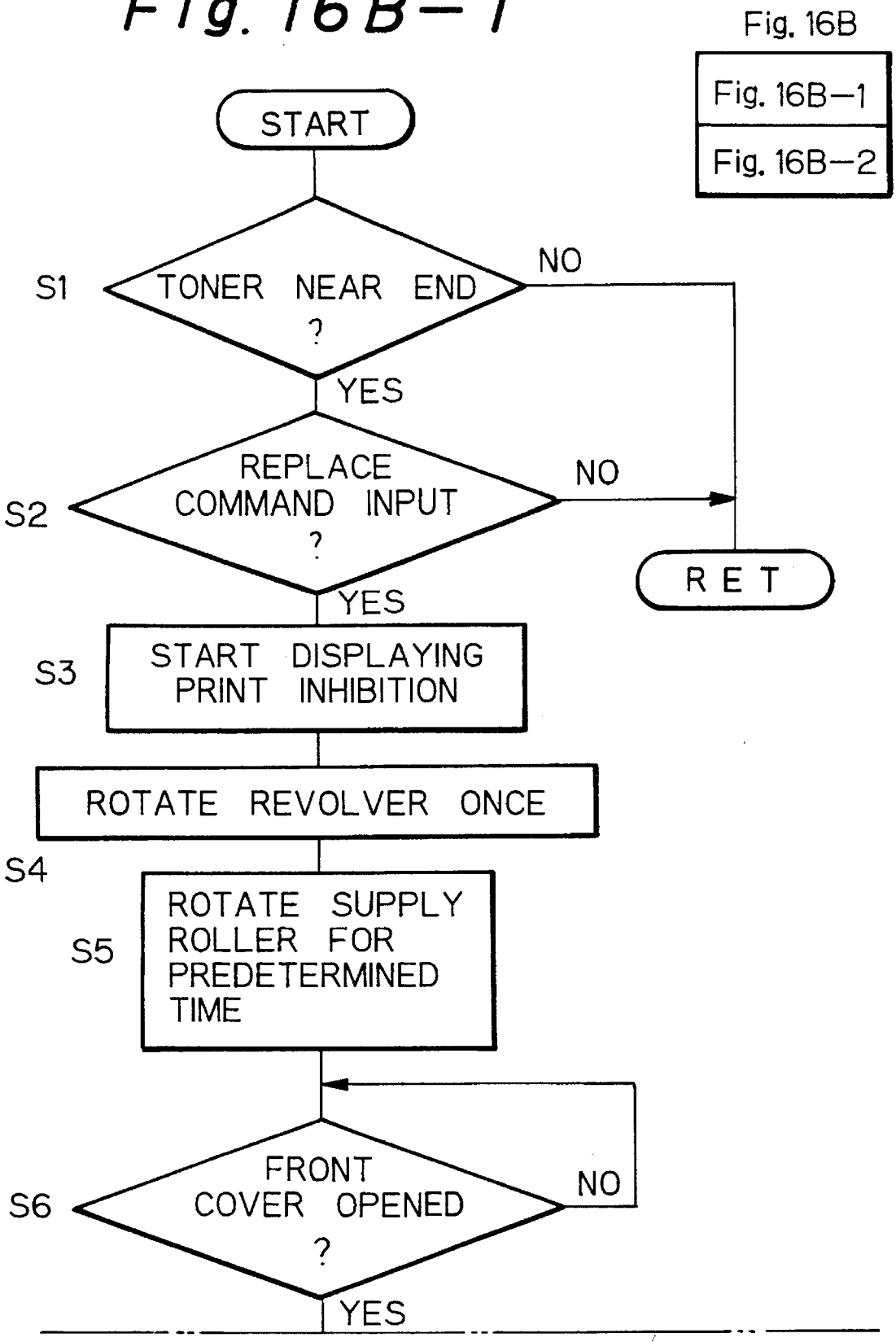
Figures 2, 16B:
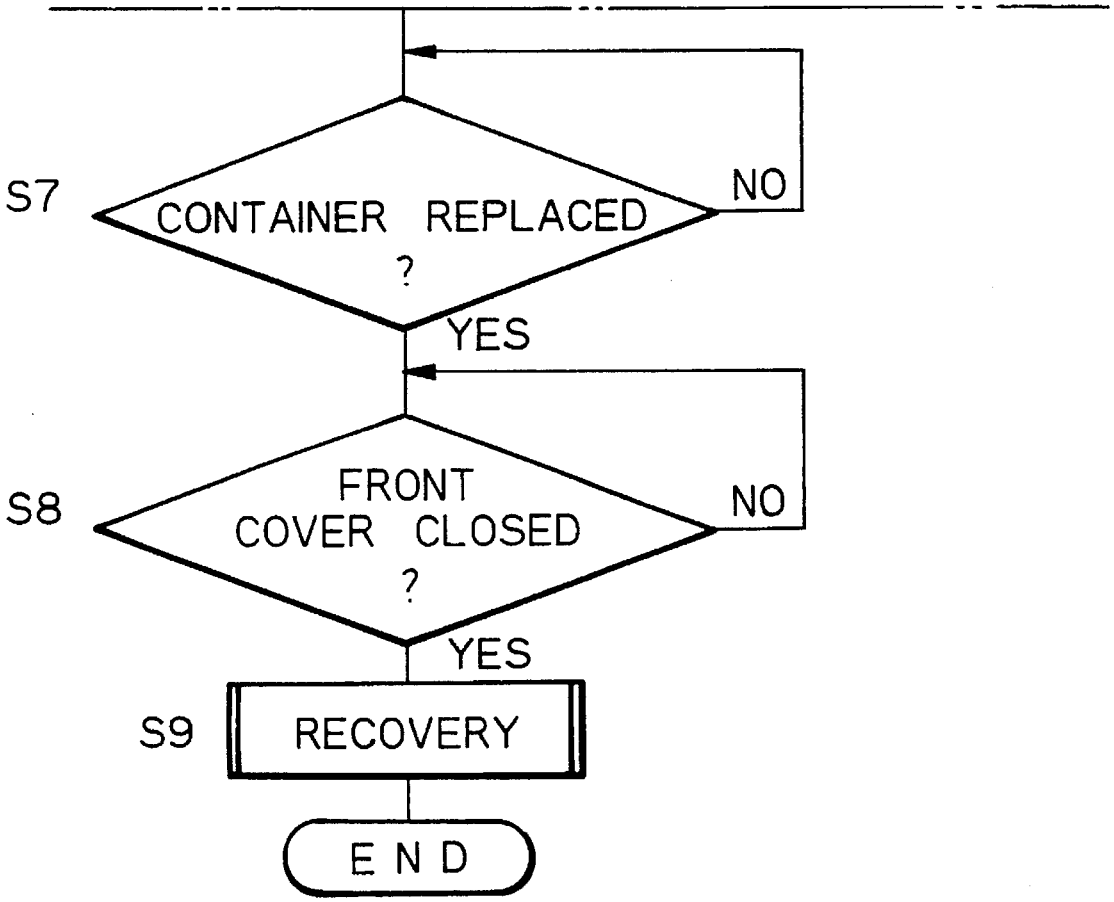

FIG. 16A demonstrates a specific routine for loosening the toner cohered at the outlet of the container, i.e., for causing the revolver to make one rotation to thereby loosen the toner by vibration. This routine begins automatically when ten more printings are produced after the toner near end condition has been reached. FIG. 16B shows a procedure in which the rotation of the revolver for the above purpose is executed in response to the replace command in the toner end condition.

As shown in FIG. 16A, after ten more printings have been produced in the toner near end condition (YES, step S3), the controller 160 starts displaying print inhibition (step S4) and then causes the revolver to make one rotation (step S5). Because print inhibition is displayed during printing in the toner near end condition, the container corresponding to the chamber located at the developing position at the beginning of one rotation of the revolver is the empty container. Hence, even when the revolver completes the rotation, the same empty container is brought to the original position where it is to be driven by the motor 61. In this condition, the supply roller is driven for a predetermined period of time to transfer the toner to the portion where the toner receiving case is communicated to the developing chamber (step S6). This successfully prevents the toner from flying about when the container is pulled out. Then, the controller 160 inhibits printing by fully deactivating the driveline (step S7).

In FIG. 16A, when the replace command is input in the toner near end condition (YES, step S2), the controller 160 displays print inhibition (step S3), causes the revolver to rotate for loosening the toner (step S4), and causes the supply roller to rotate (step S5). After the front cover has been opened (YES, step S6), the container is replaced with a new container (YES, step S7). Then, the front cover is closed (YES, step S8). After the step S8, the controller 160 executes a recovery procedure, i.e., drives the toner supply roller 97 and developing chamber for a predetermined period of time. As a result, the toner in the container 42, 43 or 44 or receptacle 110 is replenished into the developing chamber to increase the toner concentration.

The foregoing description has concentrated on the rotation of the revolver for moving the particular developing chambers for multicolor printing to the developing position. In addition, in the illustrative embodiment, the revolver is automatically rotated at an adequate timing, as follows. The toner in the black toner container 41 is replenished into the associated developing chamber via the receptacle 110 communicated to the hopper portion and chamber. In this sense, the receptacle 110 constitutes a toner inlet for the black developing chamber and is directly supplied with the toner from the container 41. Therefore, the toner must be replenished from the container 41 into the receptacle 110, particularly the hopper portion thereof, first. However, when the black developing chamber is located at the developing position, the outlet 121 of the container 41 faces upward, as shown in FIG. 9, and prevents the toner from being replenished into the hopper portion. As a result, when the hopper portion runs out of toner during continuous printing using the container 41, the toner concentration in tile chamber decreases despite that the toner is still present in the container 41. This lowers the image density or causes the toner near end detection using the reference toner image to become defective.

Figure 17A:
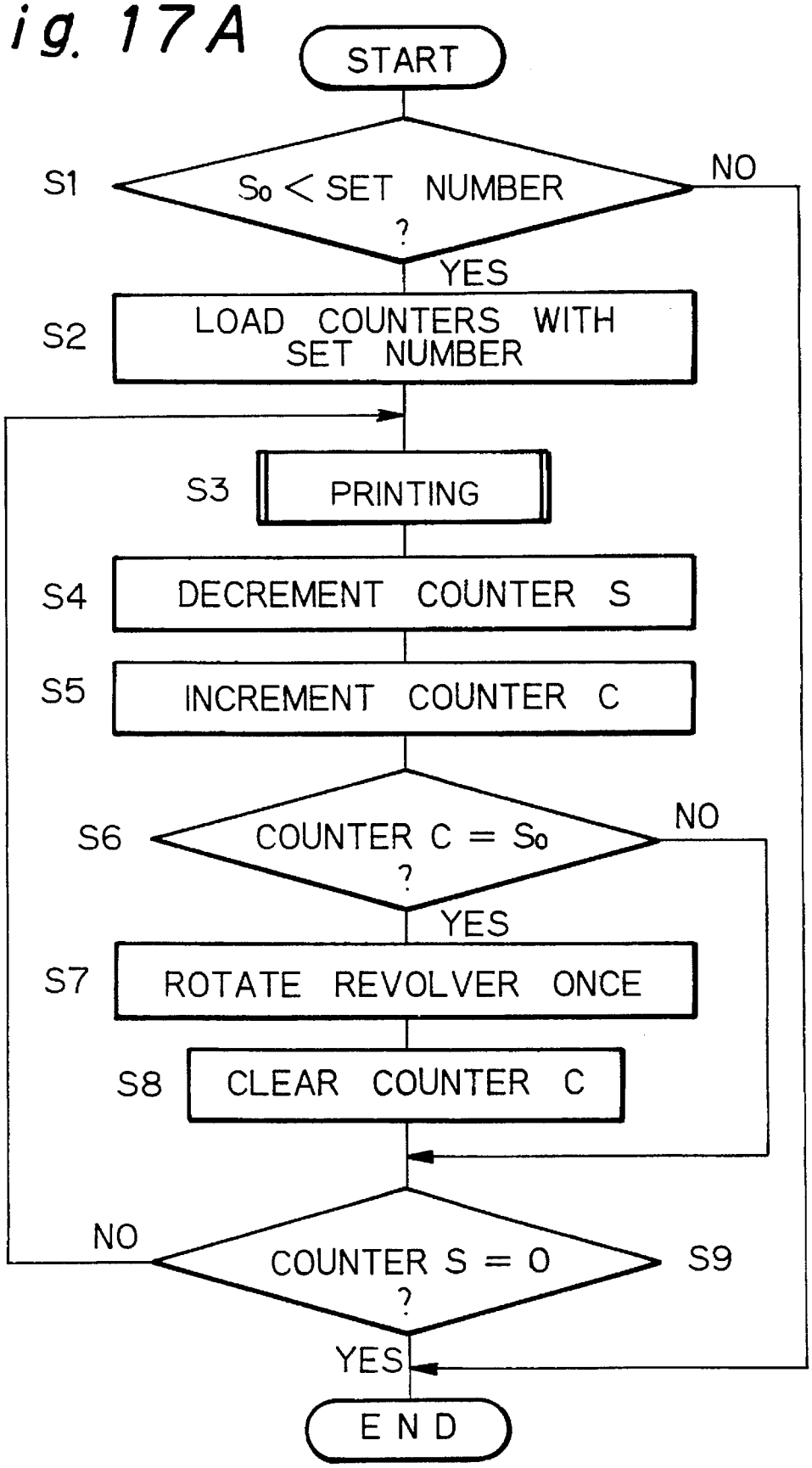
FIGS. 17A–17C each shows a specific procedure for controlling the rotation for toner replenishment.
Figure 17B:
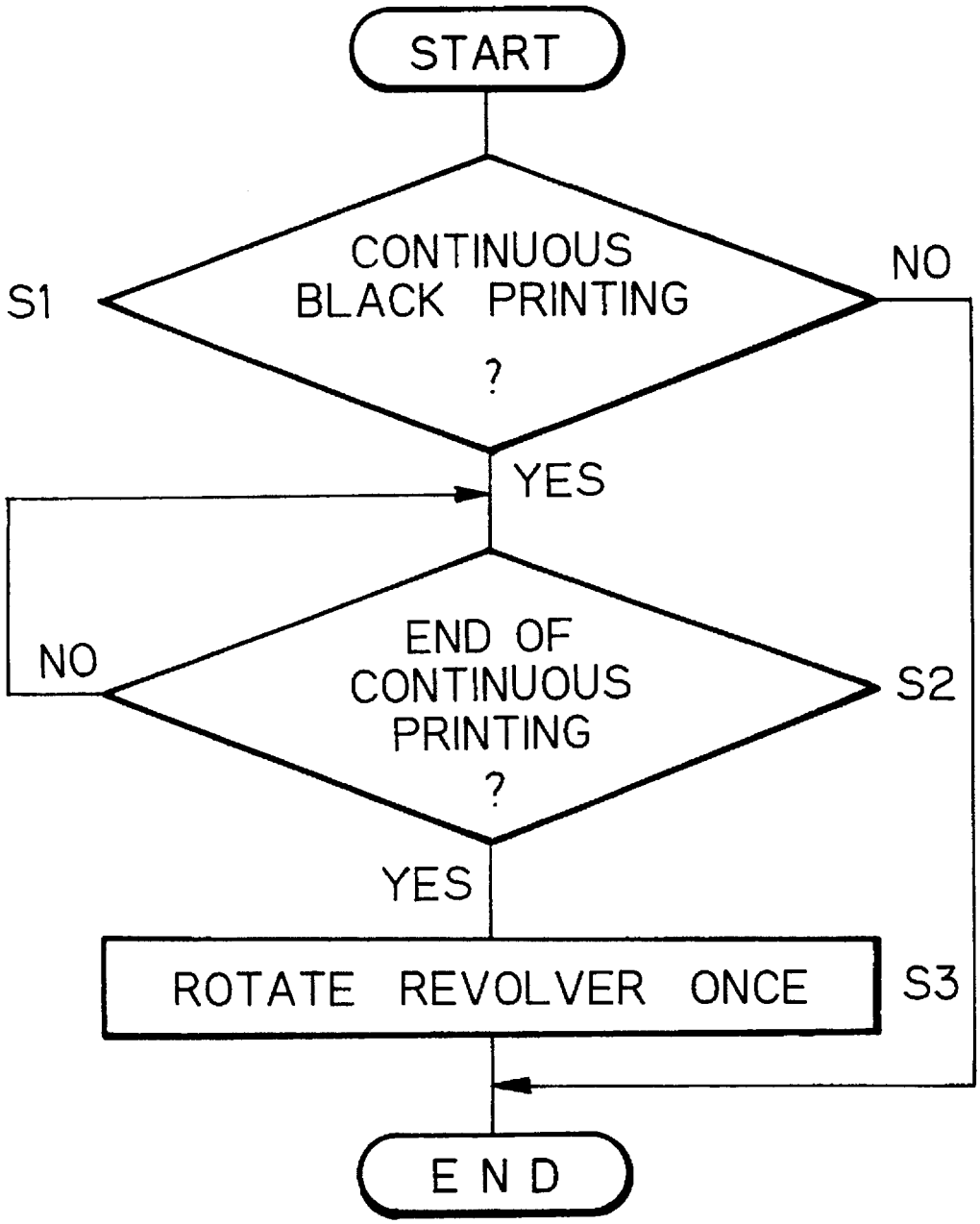
Figure 17C:
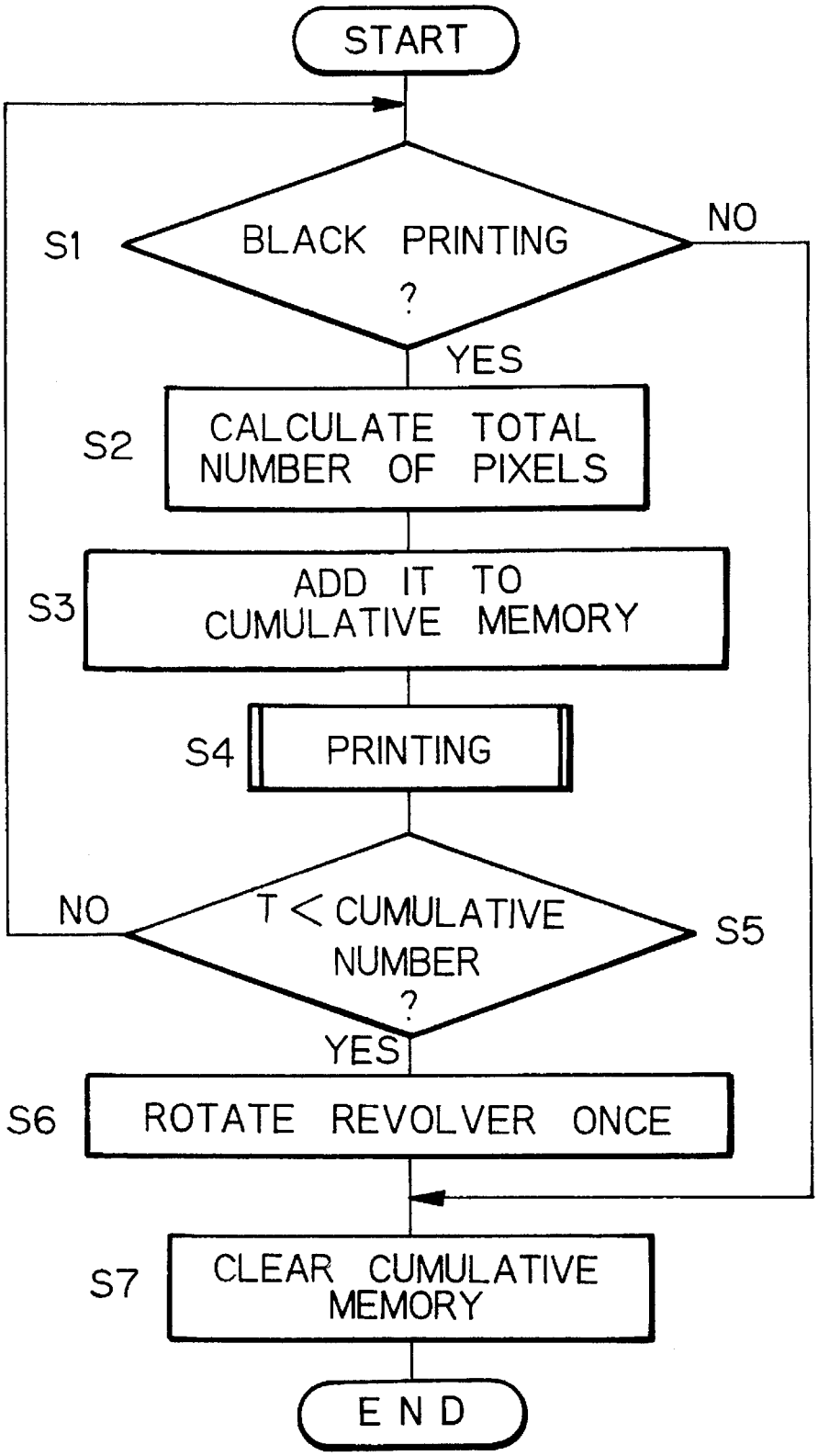

To obviate the above occurrence, the embodiment automatically rotates the revolver at an adequate timing so as to direct the outlet 121 of the container 41 downward and replenish the toner into the hopper portion. FIGS. 17A–17C each demonstrates a specific routine for rotating the revolver for this purpose.

In FIG. 17A, the controller 160 determines whether or not the desired number of printings input on the operation panel 161 is greater than a reference number $S_o$ (step S1). If the answer of the step S1 is YES, the controller 160 sets the input number on a first counter S (step S2) and then executes printing (step S3). Then, the controller 160 decrements the counter $S_o$ (step S4), increments a second counter C for determining a rotation timing (step S5), and then determines whether or not the second counter C is equal to the reference number $S_o$ (step S6). If the answer of the step S6 is NO, the controller 106 determines whether or not tile first counter S has reached zero, i.e., whether or not the desired number of printings have been produced (step S9). If the answer of the step S9 is NO, the controller returns to the step S3. When the second counter C coincides with the reference value $S_o$ (YES, step S6), the controller interrupts the printing operation and causes the revolver to make, for example, one rotation to replenish the toner into the hopper portion (step S7), and then clears the second counter C (step S8). Thereafter, the controller 160 repeats the above procedure until the answer of the step S9 turns from NO to YES.

Experiments showed that when the reference number $S_o$ is fifty, the revolver is capable of continuously producing monocolor copies if it makes three consecutive rotations for a single replenishment.

In FIG. 17B, the controller 160 determines whether or not one or more printings are to be produced by the black developing section (step S1). If the answer of the step S1 is YES, the controller 160 rotates the revolver for replenishment after all the desired copies have been produced (step S2 and S3).

Further, in FIG. 17C, the controller 160 determines whether or not printing using the black developing chamber should be executed (step S1). If the answer of the step S1 is YES, the controller 160 calculates the total number of pixels on the basis of data representative of an image to be recorded (step S2), adds the calculated number to a cumulative memory (step S3), and executes printing (step S4). Then, the controller 160 determines whether or not the cumulative memory has exceeded a predetermined number of printings T which need the rotation for replenishment (step S5). If the answer of the step S5 is NO, the controller 160 returns to the step S1. If the answer of the step S5 is YES, the controller 160 rotates the revolver for replenishment (step S6) and then clears the cumulative memory (step S7).

An arrangement may be made such that the revolver is selectively rotated in either direction away from the position where the outlet of the container 41 faces downward. This will allow the black toner to be more efficiently replenished into the hopper portion. Further, the rotation for replenishment may be interrupted for, for example, two seconds at a position where the outlet of the container 41 faces most downward (see FIG. 131)). The rotation of the revolver described above in relation to the black toner also serves to loosen the color toner which is apt to cohere around the outlet of the respective container.

Figure 18A:
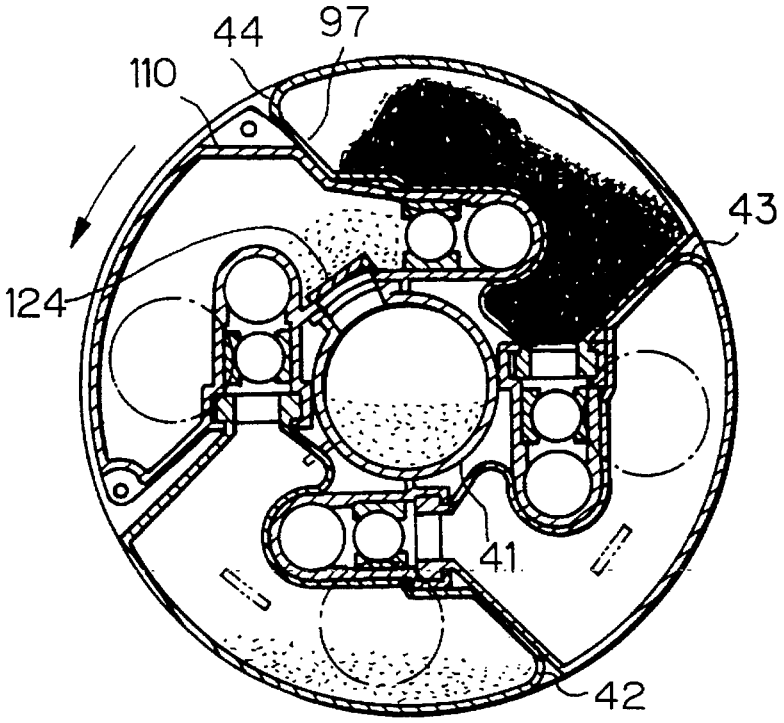
FIGS. 18A and 18B show the behavior of color toner to occur in a continuous monocolor copy mode.
Figure 18B:
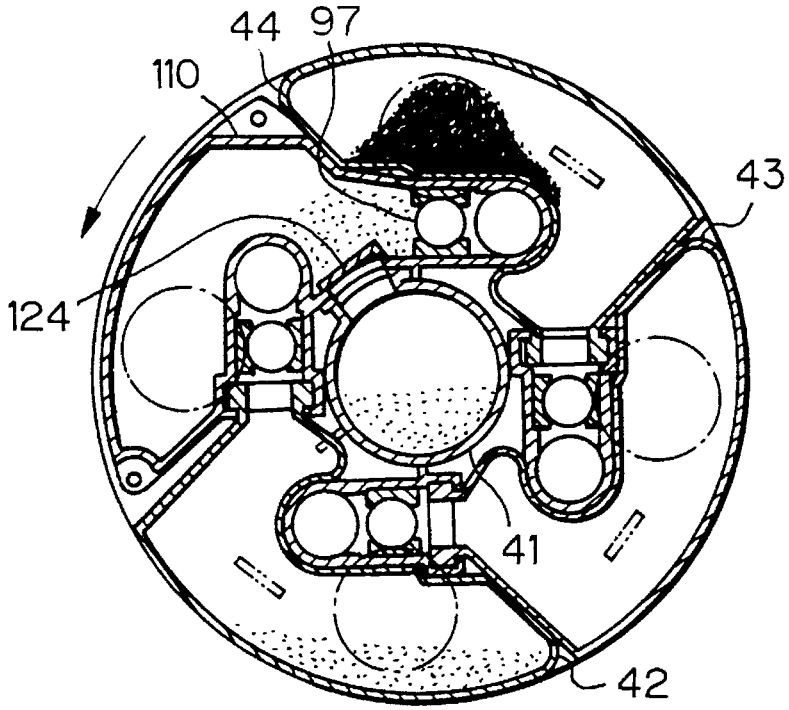
Figure 19A:
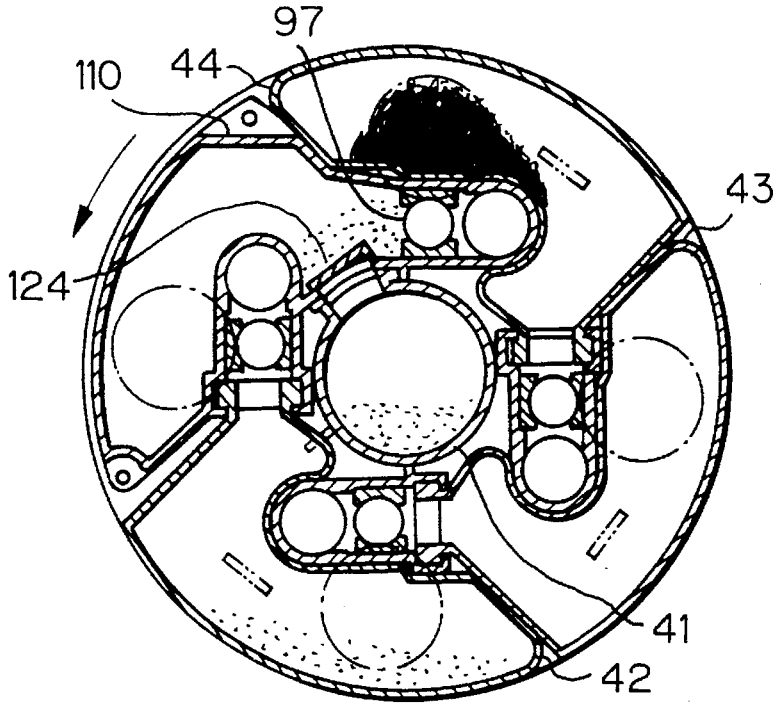
FIGS. 19A–19E demonstrate the rotation of the revolver for moving color toner in a container.
Figure 19B:
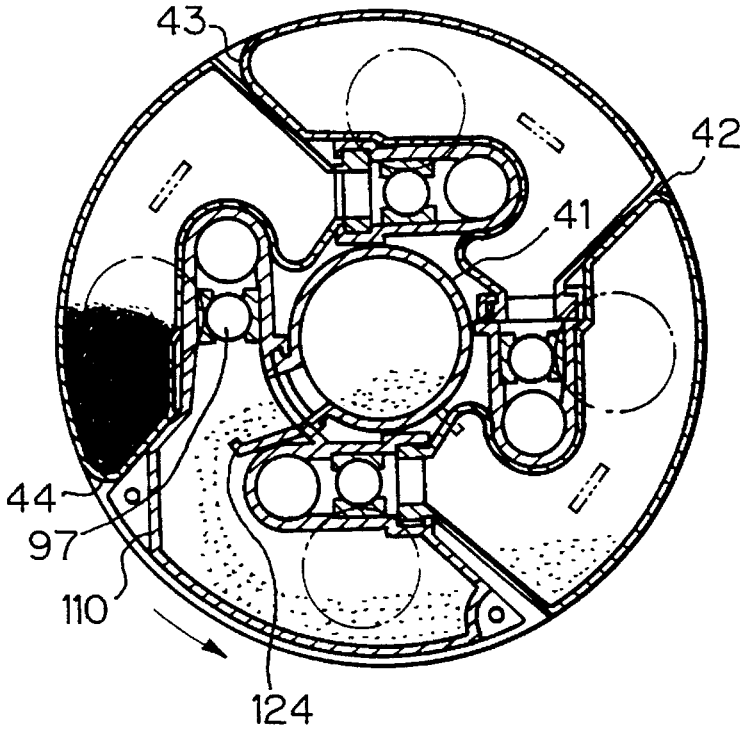
Figure 19C:
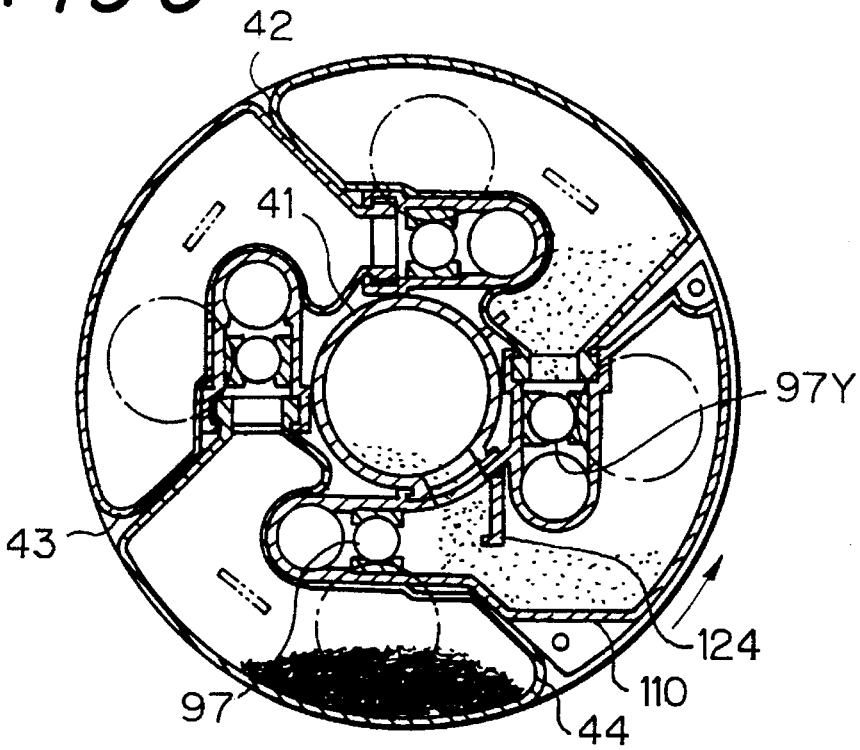
Figure 19D:
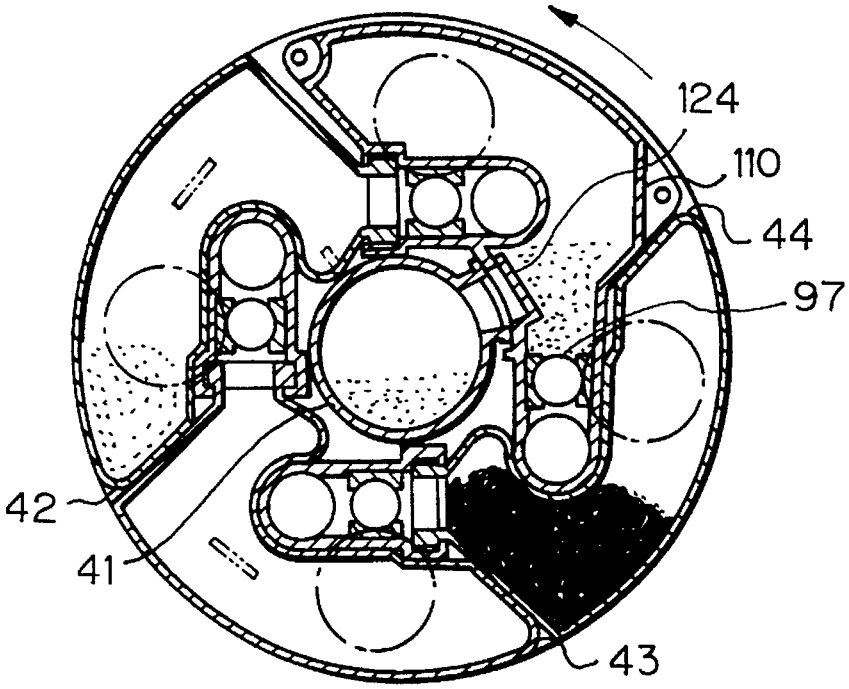
Figure 19E:
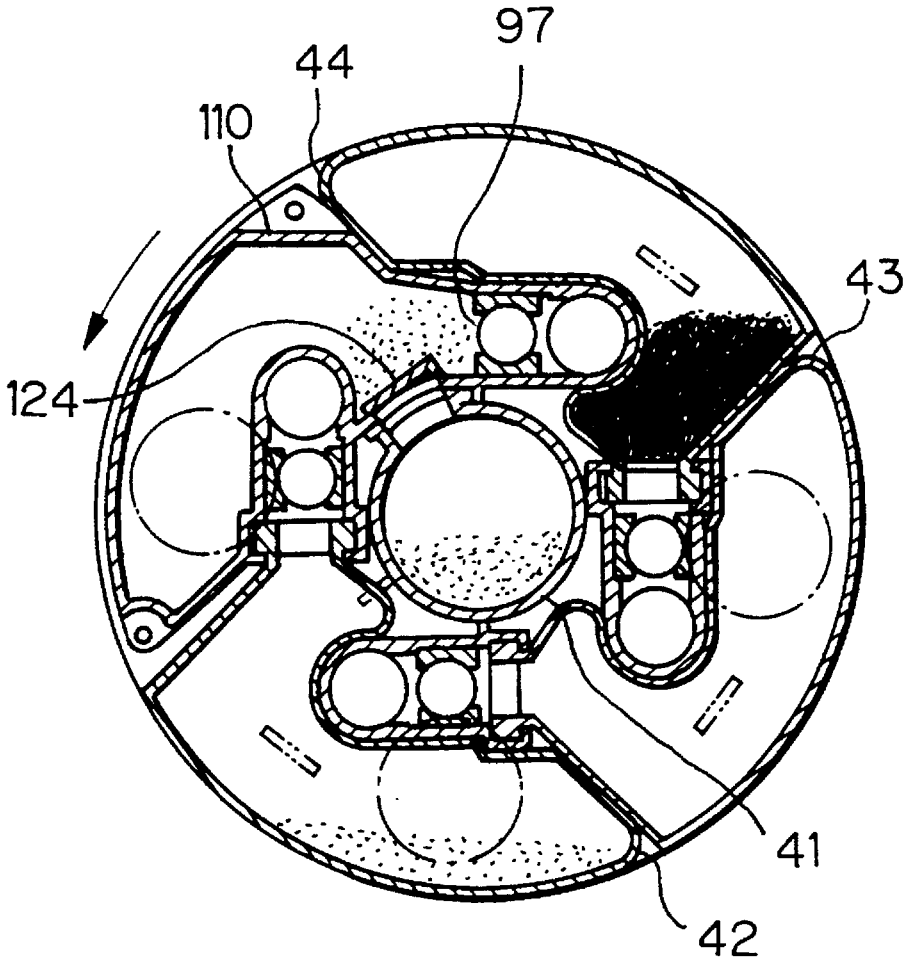

As shown in FIG. 18A, assume that the cyan toner container 44, storing a sufficient amount of toner, is continuously used to produce monocolor copies. Then, as shown in FIG. 18B, the toner positioned above the outlet of the container 44 is consumed while the toner on the horizontal inner periphery of the container 44 is left unconsumed. As a result, the fresh toner cannot be further replenished into the cyan developing chamber. To obviate this, it is preferable that the revolver be rotated to move the toner on the horizontal inner periphery of the container 44 toward the outlet, as shown in FIGS. 19A–19E. Specifically, even during continuous monocolor copying using any color toner, the revolver is rotated once for twenty or fifty printings in order to replenish the toner. This may be done alter the end of a job or, when more than twenty printings are desired, every time twenty printings are produced. As for the continuous printing using the black toner, the revolver should preferably make two or three rotations for replenishment every time, for example, fifty printings are produced or make, for example, five rotations after the turn-on of the power switch of the printer. This will further promote the loosening of the cohered toner and the replenishment of the toner into the hopper portion.

In summary, it will be seen that the present invention provides an image forming apparatus having various unprecedented advantages, as enumerated below.

(1) Only when a revolver is held in a predetermined angular range, toner can be replenished from the outlet of a toner container into the inlet of a developing chamber. This prevents the toner from being not replenished into the chamber despite that it is present in the container. The image density is prevented from decreasing despite that the toner is still present in the container. Even when a reference toner is formed to see if the toner is present in the container or not, the toner is prevented from being determined to be absent when it is present in the container.

(2) The toner is replenished into the inlet in advance every time an image forming cycle is repeated a predetermined number of times, so that an image forming operation does not have to be interrupted. This frees the operator from a waiting time attributable to the interruption of the image forming operation.

(3) The cumulative amount of toner consumption is estimated on the basis of information relating to the toner consumption in the chamber. Every time the estimated toner consumption reaches a predetermined value, the toner is replenished into the inlet. Hence, the revolver should only perform a minimum necessary rotation for the replenishment.

(4) The toner is smoothly fed into the inlet by having the fluidity thereof in the container increased. This ensures the efficient and rapid replenishment of toner into the inlet.

(5) The reverse flow of the toner from the inlet to the container is eliminated. This successfully enhances the efficient movement of the toner from the container to the inlet.

(6) The revolver is rotated at a predetermined time when the need for the replenishment of the toner from the container to the inlet is highly probable, at a preparatory timing, or at a time matching an estimated amount of toner consumption. By such a rotation of the revolver, the toner existing at the end of the container remote from the outlet is conveyed to the outlet and then replenished into the inlet. This obviates an occurrence that the toner cannot be replenished despite that it is remaining in the container.

(7) When the container is removed from a mount portion, cohered toner is absent at the outlet of the container; otherwise, it would smear the surrounding.

(8) If it is arranged beforehand that the container located at a position for replacement when, for example, a toner near end condition is displayed in response to the output of a sensor is the empty toner to be replaced, the operator can easily identify the container to be pulled out. Further, assume that a plurality of containers are determined to be empty when the apparatus satisfies the above condition. Then, the container closest to the position for replacement on the path of movement the revolver in a predetermined direction is brought to the above position first and replaced. As a result, a plurality of empty containers can be replaced in a short period of time.

(9) When the container is to be removed from the associated mount portion, the toner around the outlet of the container and the inlet of the mount portion is prevented from being scattered around without resorting to a shutter or similar closure member or even if it deposits at the outside of the closure member.

(10) The movement of the empty container to the position for replacement begins in response to the output of a manual switch. Hence, image formation may be continued until the manual switch has been pressed. In addition, when the apparatus is in a stand-by state (awaiting an image form command or being inhibited from operating), a plurality of containers may be located at their home positions to facilitate the recognition of positions, as when the apparatus awaits an image form command with all the containers full of toner. If desired, even during the interval between the time when at least one container runs out of toner and the time when the manual switch is pressed, as soon as, for example, the amount of toner remaining in the chamber associated with the empty container become too small to maintain image quality (toner end), the image formation may be entirely inhibited, or an image form command meant for the empty container may be rejected. Then, it is preferable that the empty container begins to be moved to the replacing position as soon as the toner end condition occurs.

Various modifications will become possible for those skilled in the art after receiving the teachings of the present disclosure without departing from the scope thereof.

What is claimed is:

1. An image forming apparatus comprising:

a rotary developing unit adjoining an image carrier and comprising at least one developing section having a toner inlet, and a removable toner container storing toner to be replenished into said developing section and formed with a toner outlet;

drive means for causing said developing unit to rotate; and control means for interrupting, when image formation is repeated more than a predetermined number of times, said image formation and causing said drive means to locate said developing unit in a predetermined angular range of rotation;

wherein only when said developing unit is positioned in said predetermined angular range, said toner is replenished from said toner container into said developing section or into a portion communicated to said developing section via said toner outlet and said toner inlet.

2. An apparatus as claimed in claim 1, wherein said control means operates said drive means such that said developing unit is located in said predetermined angular range every time the image formation is repeated a predetermined number of times.

3. An apparatus as claimed in claim 1, wherein said control means estimates a cumulative amount of toner consumption in response to information generated in said apparatus and corresponding to an amount of toner consumption in said developing section, and operates said drive means to locate said developing unit in said predetermined angular range every time the estimated cumulative amount reaches a predetermined amount.

4. An apparatus as claimed in claim 1, wherein said control means operates said drive means such that said developing unit enters said predetermined angular range, leaves said predetermine angular range, and again enters said predetermined angular range by being rotated in an opposite direction.

5. An apparatus as claimed in claim 1, wherein said toner outlet and said toner inlet are formed such that said toner moves from said toner outlet to said toner inlet due to a weight thereof in said predetermined angular range.

6. An apparatus as claimed in claim 5, further comprising a reverse flow preventing member for preventing said toner from flowing reversely from said toner inlet to said toner outlet in an angular range other than said predetermined angular range.

7. An image forming apparatus comprising:

a rotary developing unit adjoining an image carrier and comprising at least one developing section having a toner inlet, and a removable toner container storing toner to be replenished into said developing section and formed with a toner outlet;

drive means for causing said developing unit to rotate; and control means for interrupting, when image formation is repeated more than a predetermined number of times, said image formation and causing said drive means to locate said developing unit in a predetermined angular range of rotation;

wherein said toner container is configured such that said toner, adjoining one end of said toner container opposite to the other end where said toner outlet is present, is conveyed toward said toner outlet due to a rotation of said developing unit.

8. An image forming apparatus comprising:

a plurality of developing sections;

a plurality of toner containers each storing toner to be replenished into a respective one of said plurality of developing sections;

a plurality of mounting means each communicated to one of said plurality of developing sections or a respective portion communicated to one of said plurality of developing sections, and having a toner inlet for receiving said toner from one of said plurality of toner containers removably mounted thereto;

holding means for holding said plurality of toner containers such that said plurality of toner containers are movable integrally with said plurality of mounting means within said apparatus;

drive means for driving said holding means such that said plurality of toner containers move within said apparatus;

a plurality of sensing means each directly or indirectly determining whether or not the toner is present in said respective toner container, control means for causing said drive means to operate for a predetermined period of time in response to an output of any of said plurality of sensing means; and wherein only when one of said plurality of developing sections is positioned in a predetermined angular range, said toner is replenished from the respective one of said plurality of toner containers.

9. An apparatus as claimed in claim 8, further comprising a manual switch for causing said drive means to start operating, said control means causing said drive means to start operating in response to an output of said switch.

10. An image forming apparatus comprising:

a plurality of developing sections;

a plurality of toner containers each storing toner to be replenished into a respective one of said plurality of developing sections and having a respective toner outlet;

a plurality of mounting means each communicated to one of said plurality of developing sections or a respective portion communicated to one of said plurality of developing sections, and having a toner inlet for receiving said toner from one of said plurality of toner containers removably mounted thereto;

holding means for holding said plurality of toner containers such that said plurality of toner containers are movable integrally with said plurality of mounting means within said apparatus;

drive means for driving said holding means such that said plurality of toner containers move within said apparatus;

a plurality of sensing means each directly or indirectly determining whether or not the toner is present in a respective toner container; and control means for causing said drive means to move, in response to an output of any of said sensing means and only when a predetermined condition based on the output of said sensing means is satisfied, any of said toner containers run out of the toner to a predetermined position for replacement;

said control means causing said drive means to move, when said apparatus satisfies said predetermined condition and if a plurality of toner containers have run out of the toner as determined by said respective sensing means, one of said plurality of toner containers run out of the toner and closest to said predetermined position for replacement on a path of movement of said plurality of toner containers in a predetermined direction before moving any other one of said plurality of toner containers run out of the toner to said predetermined position for replacement.

11. An apparatus as claimed in claim 10, wherein said position for replacement is selected such that the toner around said toner inlet of one of said mounting means brought to said position for replacement does not leak from said toner inlet when said respective toner container is removed from said mounting means.

12. An apparatus as claimed in claim 10, wherein said position for replacement is selected such that the toner around said toner outlet of said toner container brought to said position for replacement does not leak from said toner outlet when said toner container is removed from said mounting means.

13. An apparatus as claimed in claim 10, further comprising a manual switch for causing said drive means to start operating, said drive means starting operating in response to an output of said manual switch.

14. An image forming apparatus comprising:

a rotary developing unit adjoining an image carrier and comprising at least one developing section having a toner inlet, and a removable toner container storing toner to be replenished into said developing section and formed with a toner outlet;

drive means for causing said developing unit to rotate;

control means for interrupting, when image formation is repeated more than a predetermined number of times, said image formation and causing said drive means to locate said developing unit in a predetermined angular range of rotation;

wherein only when said developing unit is positioned in said predetermined angular range, said toner is replenished from said toner container into said developing section or into a portion communicated to said developing section via said toner outlet and said toner inlet; and wherein said control means operates said drive means such that said developing unit enters said predetermined angular range, leaves said predetermined angular range, and again enters said predetermined angular range by being rotated in an opposite direction.

15. An image forming apparatus comprising:

a plurality of developing sections;

a plurality of toner containers each storing toner to be replenished into one of said plurality of developing sections;

a plurality of mounting means each communicated to one of said plurality of developing sections or a respective portion communicated to one of said plurality of developing sections, and having a toner inlet for receiving said toner from one of said plurality of toner containers removably mounted thereto;

holding means for holding said plurality of toner containers such that said plurality of toner containers are movable integrally with said plurality of mounting means within said apparatus;

drive means for driving said holding means such that said plurality of toner containers move within said apparatus;

a plurality of sensing means each directly or indirectly determining whether or not the toner is present in said respective toner container;

control means for causing said drive means to operate for a predetermined period of time in response to an output of any of said plurality of sensing means; and manual switch for causing said drive means to start operating, said control means causing said drive means to start operating, in response to an output of said manual switch.

* * * * *